US012241322B1

(12) United States Patent
Chen et al.

(10) Patent No.: US 12,241,322 B1
(45) Date of Patent: Mar. 4, 2025

(54) SYSTEMS AND METHODS FOR DETERMINING WEAR OF DOWNHOLE TOOLS

(71) Applicant: Schlumberger Technology Corporation, Sugar Land, TX (US)

(72) Inventors: Wei Chen, Houston, TX (US); Gregory Michael Skoff, Houston, TX (US); Huseyin Murat Panayirci, Cambridge (GB); Zhengxin Zhang, Houston, TX (US); Yuelin Shen, Houston, TX (US); Maria Lucia Cazares Gomez, Denver, CO (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/505,231

(22) Filed: Nov. 9, 2023

(51) Int. Cl.
*E21B 44/00* (2006.01)
*E21B 21/12* (2006.01)
*E21B 45/00* (2006.01)

(52) U.S. Cl.
CPC ..... *E21B 21/12* (2013.01); *E21B 45/00* (2013.01)

(58) Field of Classification Search
CPC ..... E21B 44/00; E21B 12/02; E21B 49/003; E21B 2200/20; E21B 44/005
See application file for complete search history.

(56) References Cited

U.S. PATENT DOCUMENTS 4,914,591 A * 4/1990 Warren ..... G01V 9/00 73/152.43
5,794,720 A * 8/1998 Smith ..... E21B 44/005 73/152.44
6,424,919 B1 7/2002 Moran et al.
7,258,175 B2 * 8/2007 Veeningen ..... E21B 10/00 175/50
9,022,140 B2 5/2015 Marx et al.
(Continued)

FOREIGN PATENT DOCUMENTS

WO 2014062174 A1 4/2014
WO 2014078027 A2 5/2014

OTHER PUBLICATIONS

Ringer_SPE-189582 paper "A New Workflow for Estimating Bit Wear and Monitoring Drilling Efficiency in Real Time During Drilling Operations"_2018_13 Pages.
(Continued)

*Primary Examiner* — Kipp C Wallace

(57) ABSTRACT

A method of detecting wear of a downhole tool implemented in a subject wellbore includes receiving offset wellbore data for one or more offset wellbores and, based on the offset wellbore data, determining an expected downhole tool index for the downhole tool at one or more measurement depths including an active measurement depth of the subject wellbore. The method further includes receiving subject wellbore data and, based on the subject wellbore data, determining a subject downhole tool index in real time for the downhole tool at the active measurement depth. The method further includes determining the wear of the downhole tool based on comparing the subject downhole tool index to the expected downhole tool index at the active measurement depth in real time.

21 Claims, 12 Drawing Sheets

(56) References Cited

U.S. PATENT DOCUMENTS

| | | | | |
|---|---|---|---|---|
| 2003/0015351 | A1* | 1/2003 | Goldman | E21B 49/003 175/39 |
| 2007/0093996 | A1* | 4/2007 | Cariveau | E21B 10/55 703/7 |
| 2011/0174541 | A1* | 7/2011 | Strachan | E21B 44/00 702/9 |
| 2014/0116776 | A1* | 5/2014 | Marx | E21B 12/02 706/11 |
| 2016/0053603 | A1 | 2/2016 | Israel et al. | |
| 2016/0245064 | A1* | 8/2016 | Wiercigroch | E21B 41/00 |
| 2018/0023382 | A1* | 1/2018 | Ringer | E21B 41/00 175/50 |
| 2018/0334897 | A1* | 11/2018 | Samuel | G01V 5/10 |
| 2019/0178075 | A1* | 6/2019 | Chen | E21B 44/005 |
| 2019/0345809 | A1* | 11/2019 | Jain | E21B 44/005 |
| 2020/0386905 | A1* | 12/2020 | Mitchell | G01N 23/223 |
| 2022/0282609 | A1* | 9/2022 | Samuel | E21B 47/002 |

OTHER PUBLICATIONS

Shell_SPE-189602 paper_Real-Time Bit Wear Monitoring and Prediction Using Surface Mechanics Data Analytics_A Step Toward Digitization Through Agile Development_2018_9 Pages.

Exxon_UT Austin's 2021 SPE-205844 paper Quantifying PDC Bit Wear in Real-Time and Establishing an Effective Bit Pull Criterion Using Surface Sensors_2012_20 pages.

International Search Report and Written Opinion PCT/US2023/079305 issued Jul. 15, 2024_11 pages.

* cited by examiner

| Rating: | 0 | 1 | 2 | 3 |
|---|---|---|---|---|
| Minimum | 0 | 2 | 2.5 | 3.5 |
| Maximum | 2 | 2.5 | 3.5 | 20 |
| Pattern | | | | |
| Color | | | | |
| Text | Low | Medium | High | Severe |

FIG. 4

| | | | | |
|---|---|---|---|---|
| Minimum | 0 | 10000 | 20000 | 30000 |
| Maximum | 10000 | 20000 | 30000 | 1000000 |
| Pattern | | | | |
| Color | | | | |
| Text | Low | Medium | High | Severe |

FIG. 5

SYSTEMS AND METHODS FOR DETERMINING WEAR OF DOWNHOLE TOOLS

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Tools implemented in downhole systems to form wellbores may become worn due to their interaction with, and degradation of, the subsurface formations. In many cases it may be challenging and even prohibitively difficult to discern and monitor the state of wear of downhole tools. For example, downhole drill bits are often inaccessible due to being implemented thousands of feet below the surface of the earth. Implementing worn tools may lead to inefficiencies in the operation of the downhole system, as well damaging tools beyond repair. Thus, systems and methods for determining and monitoring the wear of downhole tools may be advantageous.

SUMMARY

In some embodiments, a method of detecting wear of a downhole tool implemented in a subject wellbore includes receiving offset wellbore data for one or more offset wellbores and, based on the offset wellbore data, determining an expected downhole tool index for the downhole tool at one or more measurement depths including an active measurement depth of the subject wellbore. The method further includes receiving subject wellbore data and, based on the subject wellbore data, determining a subject downhole tool index in real time for the downhole tool at the active measurement depth. The method further includes determining the wear of the downhole tool based on comparing the subject downhole tool index to the expected downhole tool index at the active measurement depth in real time.

In some embodiments, a method of detecting wear of a downhole tool implemented in a subject wellbore includes receiving offset wellbore data for one or more offset wellbores and, based on the offset wellbore data, determining an expected downhole tool index for the downhole tool at a plurality of measurement depths including an active measurement depth of the downhole tool. The method further includes receiving subject wellbore data for the subject wellbore and, based on the subject wellbore data, determining a subject downhole tool index for the downhole tool at the plurality of measurement depths. The method further includes, based on comparing the subject downhole tool to the expected downhole tool indices, determining a cumulative wear index for the downhole tool over the plurality of measurement depths.

In some embodiments, a method of detecting wear of a downhole tool implemented in a subject wellbore includes receiving offset wellbore data for one or more offset wellbores and, based on the offset wellbore data, determining an expected formation stiffness at a plurality of measurement depths of a formation in which the one or more offset wellbores and the subject wellbore are located. The method further includes receiving subject wellbore data for the subject wellbore and, based on the subject wellbore data, determining a subject formation stiffness for the downhole tool at the plurality of measurement depths. The method further includes comparing the subject formation stiffnesses to the expected formation stiffnesses to determine a formation stiffness ratio at each of the plurality of measurement depths, and classifying the formation stiffness ratios based on one or more predetermined thresholds for the formation stiffness ratios. The method further includes determining a cumulative wear index of the downhole tool based on a summation of products of a number of revolutions of the downhole tool and a normalized formation stiffness ratio over the plurality of measurement depths.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure may be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 4 illustrates example thresholds for a formation stiffness ratio, according to at least one embodiment of the present disclosure;

FIG. 5 illustrates example thresholds for a cumulative wear index as described herein, according to at least one embodiment of the present disclosure;

DETAILED DESCRIPTION

Figure 1:
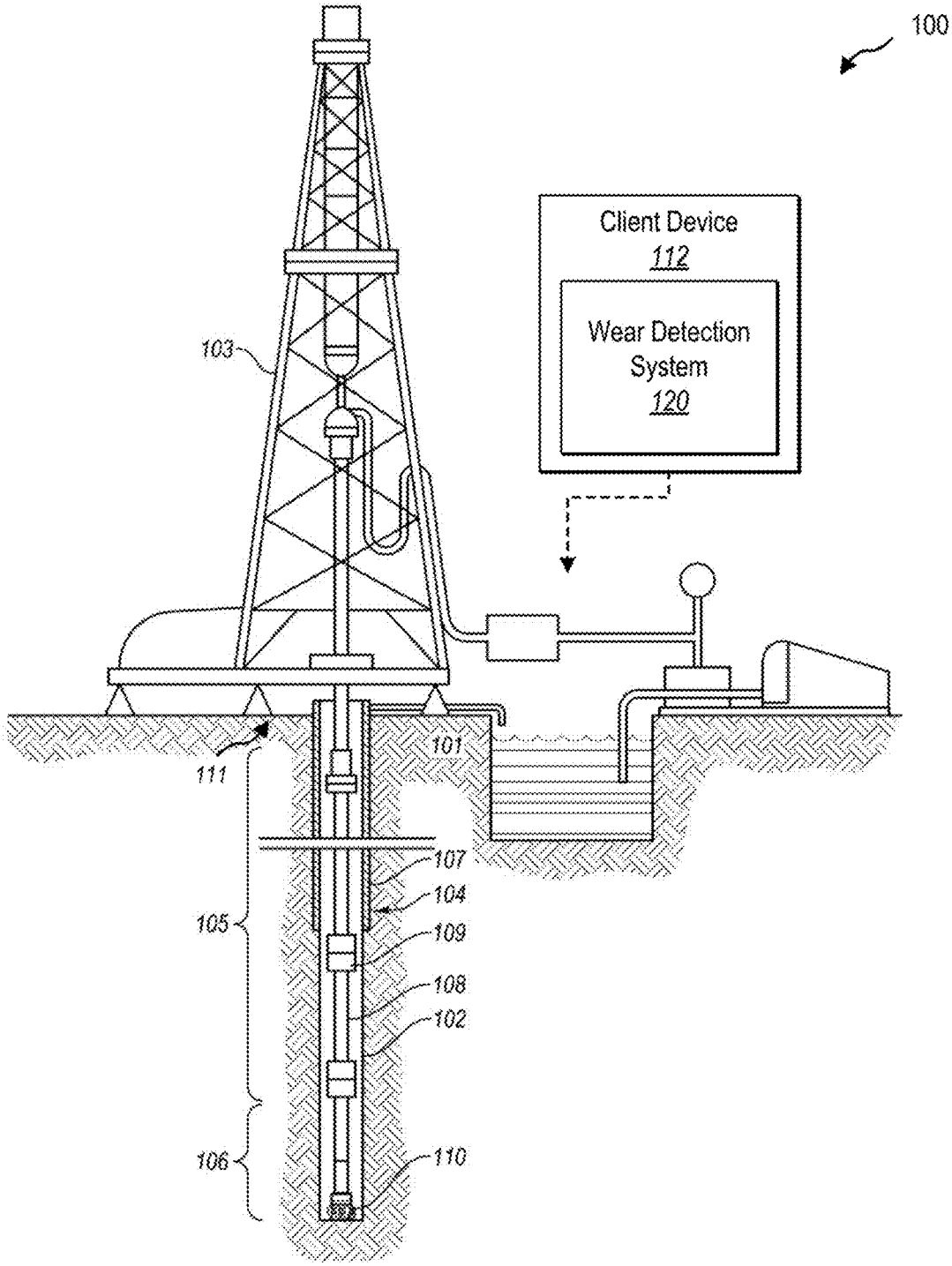
FIG. 1 is an example of a downhole system, according to at least one embodiment of the present disclosure.

This disclosure generally relates to systems and methods for determining wear of a downhole tool. A computer-implemented wear detection system may receive data for a subject wellbore as well as for one or more offset wellbores having similarities to the subject wellbore in one or more aspects. Based on the offset wellbore data, the wear detection system may determine a variety of tool indices associated with the downhole tools implemented to form these offset wellbores. The wear detection system may then determine an expected value for the associated tool indices for utilizing in conjunction with a downhole tool being actively used to drill the subject wellbore. For example, the wear detection system may determine corresponding subject downhole tool indices in real time and monitor them against the expected value. In this way, deviation of the actual values from the expected values may indicate that the downhole tool is worn, is becoming dull, or is otherwise damaged due to losing material from attrition, peeling, chipping, etc.

The wear detection system may also determine a cumulative wear index. In contrast to the tool indices, which may provide a comparison of the tool indices for single instances in time, the cumulative wear index may associate a level of wear of the downhole tool with a number of revolutions that the downhole tool completes at given wear states over a range of measurement depths. In this way, the cumulative wear index may represent a totality of the wear of the downhole tool based on an extent of the departure of the tool indices from expected values throughout an entirety of the depth of the wellbore.

The wear detection system may generate one or more reports for providing a visual representation of any of these determined metrics and may present the report via a graphical user interface of a user device. The reports may be live and/or updated in order to provide a real-time representation of one or more of the wear metrics discussed here.

As will be discussed in further detail below, the present disclosure includes a number of practical applications having features described herein that provide benefits and/or solve problems associated with determining wear of a downhole tool. Some example benefits are discussed herein in connection with various features and functionalities provided by a wear detection system implemented on one or more computing devices. It will be appreciated that benefits explicitly discussed in connection with one or more embodiments described herein are provided by way of example and are not intended to be an exhaustive list of all possible benefits of the wear detection system.

In many cases, it may be challenging to assess the wear of a downhole tool and detect that the downhole tool is worn. For example, these tools are routinely located deep within a wellbore, often thousands of feet below the surface of the earth making them inaccessible. The downhole environment is also very harsh, with high temperature, extreme pressures, and abrasive formations limiting the availability of implementing sensors or other electronic devices dedicated to detecting bit wear. Additionally, even when these tools may be inspected and assessed, characterizing the wear is often manually performed by skilled and experienced personnel, which introduces elements such as subjectivity, human error, fatigue, and inconsistency. The techniques of the present disclosure, however, provide a variety of quantifiable and measurable metrics for assessing tool wear, providing an objective, verifiable method of determining whether a downhole tool is dull, and to what extent. Indeed, the present techniques not only provide wear metrics for comparing against expected values, but may determine and present this information live, in real-time, and while drilling. Thus, the wear detection system describe herein may facilitate a real-time monitoring of the wear of a downhole tool.

Additionally, the techniques described herein may be performed without the need for specialized or dedicated tools and sensors for measuring wear metrics of the downhole tool. The wear metrics are based on several measurements or data channels which may be easily and/or routinely gathered by a downhole system, such as a rate of penetration, weight on bit, rotational speed (RPM), torque, etc., of the downhole tool. Based on this information (both for the subject wellbore and for the offset wellbore data utilized for determining the expected values) the wear detection system may determine several wear metrics for the downhole tool and may present the wear metrics in simple, intuitive, and accessible ways in order that the wear of the downhole tool may be discerned. Indeed, the underlying data for this technique may be downhole data measured directly at or near the downhole tool, or may even be estimated based on only surface data where downhole data is not available. Thus, the wear detection system may be easily and widely implemented in many downhole systems.

Further, conventional techniques may ascertain that a downhole tool is dull based on a reduced productivity of the downhole system, such as a reduced rate of penetration, increased weight on bit, or other observation. Low rate of penetration drilling, however, may be costly due to inefficiencies and extended drilling times. Drilling with increased levels of weight on bit may led to premature wear of components of the downhole system. Additionally, bits may already be significantly worn or damaged at the point of identifying such underperformance of the downhole system resulting in waste of resources to replace bits that could otherwise have been repaired or refurbished. By characterizing and monitoring the bit wear in a quantifiable way, the wear detection system may help to prevent operating the downhole system in an inefficient manner due to implementing worn bits. Indeed, by ascertaining the extent of the wear of the bit, bits may be removed and/or replaced before incurring damage past a point of repair. In this way, the wear detection system may reduce cost and increase productivity of a downhole system.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface 111. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the drill string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface 111 or may be allowed to fall downhole. The bit 110 may include one or more cutting elements for degrading the earth formation 101.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

The downhole system 100 may include or may be associated with one or more client devices 112 with a wear detection system 120 implemented thereon (e.g., implemented on one, several, or across multiple client devices 112). The wear detection system 120 may facilitate determining a wear of one or more downhole tools, such as wear of the bit 110.

Figure 2:
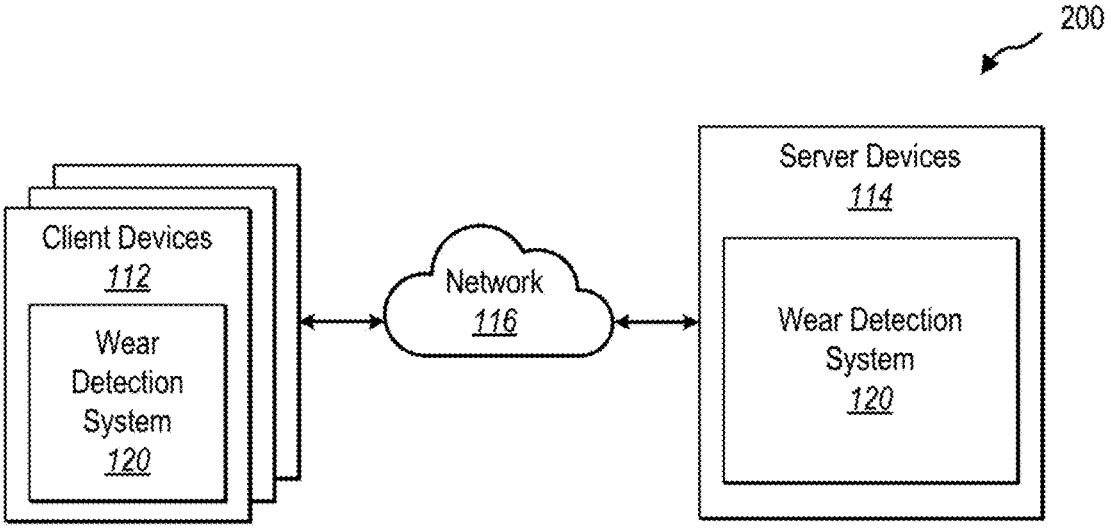
FIG. 2 illustrates an example environment in which a wear detection system is implemented, according to at least one embodiment of the present disclosure.

FIG. 2 illustrates an example environment 200 in which a wear detection system 120 is implemented in accordance with one or more embodiments describe herein. As shown in FIG. 2, the environment 200 includes one or more server device(s) 114. The server device(s) 114 may include one or more computing devices (e.g., including processing units, data storage, etc.) organized in an architecture with various network interfaces for connecting to and providing data management and distribution across one or more client systems. As shown in FIG. 2, the server devices 114 may be connected to and may communicate with (either directly or indirectly) one or more client devices 112 through a network 116. The network 116 may include one or multiple networks and may use one or more communication platforms and/or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may refer to various types of computing devices. For example, one or more client devices 112 may include a mobile device such as a mobile telephone, a smartphone, a personal digital assistant (PDA), a tablet, a laptop, or any other portable device. Additionally, or alternatively, the client devices 112 may include one or more non-mobile devices such as a desktop computer, server device, surface or downhole processor or computer (e.g., associated with a sensor, system, or function of the downhole system), or other non-portable device. In one or more implementations, the client devices 112 include graphical user interfaces (GUI) thereon (e.g., a screen of a mobile device). In addition, or as an alternative, one or more of the client devices 112 may be communicatively coupled (e.g., wired or wirelessly) to a display device having a graphical user interface thereon for providing a display of system content. The server device(s) 114 may similarly refer to various types of computing devices. Each of the devices of the environment 200 may include features and/or functionalities described below in connection with FIG. 13.

As shown in FIG. 2, the environment 200 may include a wear detection system 120 implemented on one or more computing devices. The wear detection system 120 may be implemented on one or more client device 112, server devices 114, and combinations thereof. Additionally, or alternatively, the wear detection system 120 may be implemented across the client devices 112 and/or the server devices 114 such that different portions or components of the wear detection system 120 are implemented on different computing devices in the environment 200. In this way, the environment 200 may be a cloud computing environment, and the wear detection system 120 may be implemented across one or more devices of the cloud computing environment in order to leverage the processing capabilities, memory capabilities, connectivity, speed, etc., that such cloud computing environments offer in order to facilitate the features and functionalities described herein.

Figure 3:
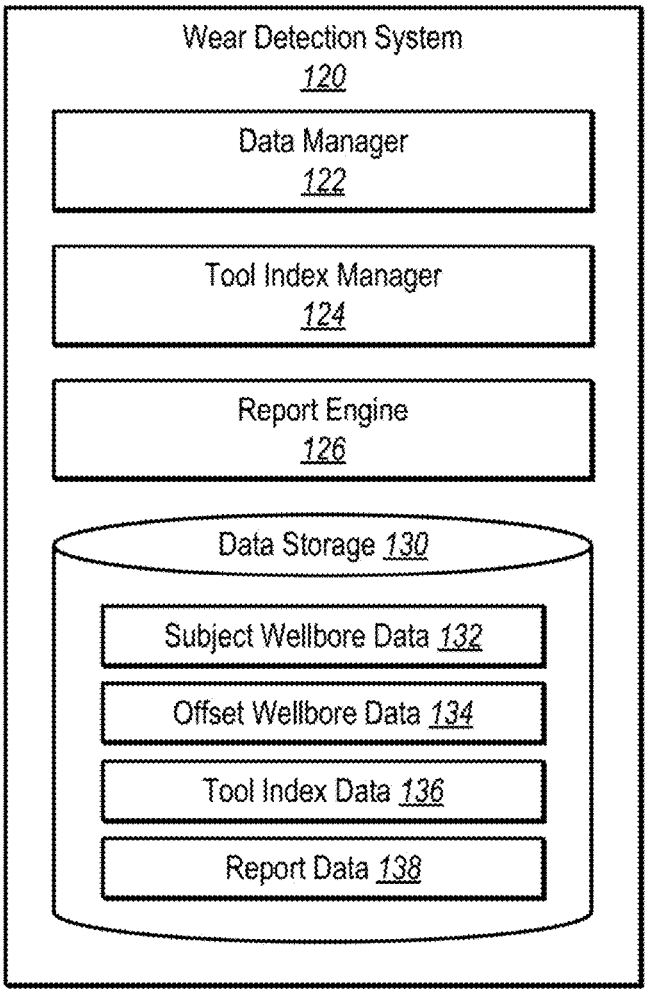
FIG. 3 illustrates an example implementation of a wear detection system as described herein, according to at least one embodiment of the present disclosure.

FIG. 3 illustrates an example implementation of the wear detection system 120 as described herein, according to at least one embodiment of the present disclosure.

The wear detection system 120 may include a data manager 122, a tool index manager 124, and a report engine 126. The wear detection system 120 may also include a data storage 130 having subject wellbore data 13, offset wellbore data 134, tool index data 136, and report data 138 stored thereon. While one or more embodiments described herein describe features and functionalities performed by specific components 122-126 of the wear detection system 120, it will be appreciated that specific features described in connection with one component of the wear detection system 120 may, in some examples, be performed by one or more of the other components of the wear detection system 120.

By way of example, one or more of the data receiving, gathering, or storing features of the data manager 122 may be delegated to other components of the wear detection system 120. As another example, while data may be selected, aligned, filtered, and/or modified by a data manager 122, in some instances, some or all of these features may be performed by the tool index manager 124 (or other component of the wear detection system 120). Indeed, it will be appreciated that some or all of the specific components may be combined into other components and specific functions may be performed by one or across multiple components 122-126 of the wear detection system 120.

Additionally, while FIG. 1, for example, depicts the wear detection system 120 implemented on a client device 112 of the downhole system, it should be understood that some or all of the features and functionalities of the wear detection system 120 may be implemented on or across multiple client devices 112 and/or server devices 114. For example, data may be input and/or received by the data manager 122 on a (e.g., local) client device, and one or more tool indices may be determined by the tool index manager 124 on one or more of a remote, server, or cloud device. Indeed, it will be appreciated that some or all of the specific components 122-128 may be implemented on or across multiple client devices 112 and/or server devices 114, including individual functions of a specific component being performed across multiple devices.

As mentioned above, the wear detection system 120 includes a data manager 122. The data manager 122 may receive a variety of types of data associated with the downhole system and may store the data to the data storage 130. The data manager 122 may receive the data from a variety of sources, such as from sensors, surveying tools, downhole tools, other (e.g., client) devices, user input, etc.

In some embodiments, the data manager 122 receives subject wellbore data 132 for a subject wellbore. The subject wellbore may be a wellbore of the downhole system associated with the wear detection system 120 as described herein. The subject wellbore may be a wellbore in which a (e.g., subject) downhole tool is actively implemented, or a wellbore that is being actively drilled, lengthened, widened, or otherwise formed.

The subject wellbore data 132 may include information associated with the subject wellbore. For example, the subject wellbore data 132 may indicate one or more of a rate of penetration (ROP), weight on bit (WOB), and rotational speed (RPM) of a subject downhole tool implemented in the subject wellbore. For example, the data manager 122 may receive the subject wellbore data 132 from one or more downhole sensors and/or surface sensors. The subject wellbore data 132 may indicate one or more measurement depths with respect to one or more measurements of the subject wellbore. The subject wellbore data 132 may include any other data, such as torque, pump pressure, flow rate, etc., associated with the subject wellbore and/or with the downhole system. The subject wellbore data 132 may include formation evaluation data, directional drilling data, mud and fluid analysis data, pressure and temperature data, or any other type of data. The data manager 122 may store the subject wellbore data 132 to the data storage 130.

In some embodiments, some or all the subject wellbore data 132 is measured directly. For example, the data manager 122 may receive one or more of a ROP, WOB, and RPM for the subject downhole tool based on real-time downhole data channel(s) that directly measure the associated value. In some embodiments, some or all the subject wellbore data 132 is indirectly measured and/or is calculated or estimated based on indirect (e.g., surface) measurements. For example, an RPM of a subject downhole tool may be estimated based on a motor curve for a mud motor of the downhole system from data channels, such as a flow rate in and/or a differential pressure of the mud motor measured at the surface. In another example, a downhole WOB may be estimated based on a surface WOB. In this way, the data manager 122 may receive the subject wellbore data 132 in a variety of ways. This may facilitate accommodating downhole systems of varying levels of cost and/or sophistication. For example, low-cost and/or less sophisticated downhole systems may have fewer data channels and/or measurement equipment for taking downhole measurements and may be limited to surface measurements. As another example, higher-cost and/or more sophisticated downhole systems may have more data channels and/or measurement equipment for taking downhole measurements in addition to surface measurements. In this way, the data manager 122 may collect and/or estimate the relevant data in a variety of ways in order to facilitate implementing the wear detection system 120 within any downhole system.

In some embodiments, the data manager 122 receives at least some of the subject wellbore data 132 in real time. For example, the data manager 122 may be in data communication with one or more downhole or surface sensors and may receive the subject wellbore data 132, such as a ROP, WOB and/or RPM in real time as the subject wellbore is being actively drilled. These real-time measurements may facilitate one or more of the active and/or real time functionalities of the wear detection system 120 as described herein.

In some embodiments, the data manager receives offset wellbore data 134 for one or more offset wellbores. For example, the offset wellbore data 134 may be associated with a global database for data of all known or available offset wellbores. In another example, the offset wellbore data 134 may be associated with a selection of offset wellbores similar or related to the subject wellbore as described herein.

The offset wellbore data 134 may include any of the data described above in relation to the subject wellbore data 132, but for the offset wellbores. For example, the offset wellbore data 134 may indicate a ROP, WOB, and RPM of an offset downhole tool implemented in an associated offset wellbore. The offset wellbore data 134 may indicate one or more measurement depths of the offset wellbores in relation to any of the data included in the offset wellbore data 134. The offset wellbore data 134 may include any other data associated with the offset wellbores. The offset wellbore data 134 may be collected, measured, calculated, or otherwise received in any of the manners described above with respect to the subject wellbore data 132. The data manager 122 may store the offset wellbore data 134 to the data storage 130.

In some embodiments, the data manager 122 separates some or all of the offset wellbore data 134 into specific runs. For example, in some cases, multiple runs of one or more offset downhole tools may be made at or within a single wellbore or wellsite, such as to drill different parts of a wellbore, to implement different offset downhole tools within a wellbore, to perform different downhole operations within a wellbore, or to create one or more sidetrack wells off of a wellbore. Accordingly, the data manager 122 may separate the offset wellbore data 134 for a specific offset wellbore or wellsite to represent the various runs into the offset wellbore by one or more offset downhole tools.

In some embodiments, the offset wellbore data 134 includes an indication of a type and/or extent of wear of an offset downhole tool (e.g., a bit) implemented in the associated offset wellbore. For example, the offset wellbores may be wellbores that are already drilled (or are already drilled to or past a measurement depth of interest), and the associated offset downhole tool may have been removed or tripped to the surface for inspection. The offset wellbore data 134 may indicate a classification of a drill bit dull grade for the offset downhole tool, such as based on a IADC dull grade standard. For instance, the offset wellbore data 134 may indicate, for an offset downhole tool, one or more of an inner grade, an outer grade, and a dull characteristic such as ring-out or core-out. In this way, the offset wellbore data 134 may indicate a condition or state of wear of an offset downhole tool associated with a corresponding offset wellbore.

In some embodiments, the data manager 122 selects one or more offset wellbores (e.g., from a database or global collection of offset wellbores) in order to receive the offset wellbore data 134 for those selected offset wellbores. For example, the data manager 122 may identify one or more offset wellbores that have one or more similarities to the subject wellbore. For instance, the similar offset wellbores may be wellbores that are within a same basin, oilfield, region, location, or otherwise are geographically near the subject wellbore. The similar offset wellbores may be wellbores that extend a same or similar depth or range of depths, penetrate a same or similar formation, access a same or similar reservoir, follow a same or similar trajectory (or a portion of a trajectory), have one or more of the same or similar bends or doglegs, or otherwise exhibit a same or similar feature or aspect as the subject wellbore, and combinations thereof. The data manager 122 may accordingly receive the offset wellbore data 134 for these selected similar offset wellbores in order that the offset wellbore data 134 may be relevant to the subject wellbore data 132.

In some embodiments, the data manager 122 filters the offset wellbore data 134 based on one or more offset wellbores. For example, the data manager 122 may separate or exclude some of the offset wellbore data 134 based on a classification of the drill bit dull grade associated with the corresponding offset wellbore. For instance, the data manager 122 may filter out offset wellbore data 134 associated with offset wellbores having an inner grade and/or an outer grade above one or more thresholds. The data manager 122 may filter out offset wellbore data 134 having one or more specific dull characteristics, such as ring-out or core-out.

As an example, in some cases it may be advantageous to utilize offset wellbore data 134 for wellbores that are not associated with offset downhole tools that were severely dull or damaged (e.g., when removed from the offset wellbore and inspected). The data manager 122 may accordingly filter out offset wellbore data 134 for offset wellbores having one or more of an inner grade of 4 or higher (out of 8), an outer grade of 4 or higher (out of 8), a ring-out characteristic, and a core-out characteristic based on an IADC dull grade standard. Filtering out the severe-wear offset wellbore data 134 may be a minimum or worst-case constraint for implementing the wear detection techniques described herein. In some cases, such as where sufficient offset wellbore data 134 is available, the data manager 122 may filter out offset wellbore data 134 in a more restrictive manner, such as filtering out offset wellbore data 134 for wellbores that are associated with offset downhole tools that exhibit anything more than a slight level of wear. For example, the data manager 122 may filter based on wellbores having one or more of an inner grade of 2 or higher, an outer grade of 2 or higher, or any associated wear characteristic (e.g., ring-out or core-out) on an IADC dull grade standard. In this way, the data manager 122 may filter the offset wellbore data 134 with one or more thresholds of a dull grade standard based on an availability of the offset wellbore data 134. This may facilitate selecting not only a sufficient amount of offset wellbore data 134 in order to implement the techniques described herein, but may also facilitate selecting the best possible data, for example, for the best runs of offset downhole tools that exhibited less wear. This may facilitate determining with a high confidence that the expected tool indices determined by the wear detection system 120 (as described herein) are an accurate representation of the properties that these indices represent, and are not significantly influenced or affected by dull or worn state of the associated offset downhole tools.

In some embodiments, the data manager 122 does not eliminate some of the offset wellbore data 134 based on the dull grade standard, but separates or categorize the offset wellbore data 134 based on the dull grade standard. For example, the data manager 122 may separate the offset wellbore data 134 into a severe-wear group and a not-severe-wear group of the offset wellbore data 134. In another example the data manager 122 may separate the offset wellbore data 134 into a wear-group and a no/slight-wear group. Classifying the offset wellbore data 134 in this way may facilitate one or more of the features described herein.

In some embodiments, the data manager 122 receives formation data. The formation data may include information associated with a formation in which the subject wellbore and/or the one or more offset wellbores traverse, penetrate, or are otherwise located (e.g., the subject wellbore data 132 and/or the offset wellbore data 134 may include formation data). For example, the formation data may include information about the geological characteristics of the rock encountered during drilling the subject wellbore and/or the offset wellbores. The formation data may include data from gamma ray sensors, resistivity sensors, porosity sensors, density sensors, sonic sensors, calipers, core samples, or any other formation data. The formation data may indicate the boundaries of different underground formations, such as a top, bottom, and/or thickness of one or more formations. The formation data may indicate one or more measurement depths associated with any of the measurements and/or data described above. In this way, the formation data may identify one or more formations of interest, for example, with respect to the subject wellbore data 132 and/or the offset wellbore data 134.

In some embodiments, the data manager 122 prepares and/or modifies any of the data it receives and/or has access to. For example, in some cases, wellbore data may be measured and/or recorded in a time-domain. The data manager 122 may translate or depth-gate the data into a depth domain. Put another way, the data manager 122 may modify the data to express the data with respect to measurement depth, for example, instead of with respect to time. Translating the data in this way may facilitate conceptualizing the data and/or the tool indices described herein such that the data may be considered with respect to one or more measurement depths or ranges of measurement depths.

In some embodiments, the data manager 122 aligns one or more instances of the subject wellbore data 132 and/or the offset wellbore data 134. For example, the data manager 122 may align the subject wellbore data 132 and/or some or all of the offset wellbore data 134 based on a measurement depth or a range of measurement depths (e.g., of interest). In another example, the data manager 122 may align the subject wellbore data 132 and/or some or all of the offset wellbore data 134 based on a formation. For instance, based on the subject wellbore and the offset wellbores penetrating or traversing a same formation, the data manager 122 may align or associate the subject wellbore data 132 measured within the formation with some or all of the offset wellbore data 134 also measured within the same formation (of a respective offset wellbore). The data manager 122 may align the data based on a top of the formation. In some embodiments, this results in the measurement depths of the subject wellbore data 132 and/or some or all of the offset wellbore data 134 being misaligned at one or more locations. For example, a formation may exhibit a slope or dip such that two or more wellbores may reach or penetrate the (e.g., top of the) formation at different measurement depths. It may be advantageous as descried herein to relate the wellbore data of the associated wellbores with respect to the (e.g., location within the) formation as opposed to strictly with respect to the measurement depth, and the data manager 122 may accordingly align the data based on the formation. In some situations, a formation may exhibit a different thickness at one or more locations such that two or more wellbores may penetrate or pass through different thicknesses of the formation. In some embodiments, the data manager 122 compresses and/or stretches the subject wellbore data 132 and/or some or all of the offset wellbore data 134 to account for the differences in thickness. This adjustment may be in addition to the data manager 122 aligning (e.g., a depth of) the data based on the formation. In this way, the data manager 122 may modify the subject wellbore data 132 and/or the offset wellbore data 134 in order to facilitate relating data for any wellbores of interest based on a formation in which the wellbores are positioned (e.g., as opposed to depth).

In some embodiments, the data manager 122 receives user input. The data manager 122 may receive the user input, for example, via any of the client devices 112 and/or server devices 114. Any of the data described herein may be input or augmented via the user input. For example, in some instances, some or all of the offset wellbore data is received by the data manager 122 as user input. The user input may be received in association with one or more functions or features of the wear detection system 120, such as part of selecting one or more offset wellbores for the offset wellbore data 134, selecting one or more thresholds for classifying tool indices, or any other feature described herein.

As mentioned above, the wear detection system 120 includes a tool index manager 124. The tool index manager 124 may determine and monitor one or more downhole tool indices for characterizing and/or quantifying a wear of the subject downhole tool implemented in the subject wellbore. The downhole tool indices may describe or represent one or more properties or characteristics of the formation and/or of a downhole tool used to degrade the formation of an associated wellbore.

In some embodiments, the tool index manager 124 determines one or more expected downhole tool indices (or expected values of a downhole tool index) based on the offset wellbore data 134. For example, as discussed below, the tool index manager 124 may determine a formation stiffness at one or more (or all) measurement depths for each offset wellbore of the offset wellbore data 134. The tool index manager 124 may determine an average, median, percentile, or any other statistical calculation of the determined formation stiffnesses of the offset wellbores as the expected formation stiffness for the subject wellbore at the one or more measurement depths (e.g., or formation-aligned measurement depths). In accordance with at least one embodiment of the present disclosure, the tool index manager 124 determines the expected formation stiffness as a median value of the determined formation stiffnesses of the offset wellbores. In some embodiments, the tool index manager 124 determines a threshold range such as maximum and/or minimum formation stiffnesses based on the determined formation stiffnesses of the offset wellbores. For example, the tool index manager 124 may determine a maximum or upper threshold as a $75^{th}$ percentile (P75), a $90^{th}$ percentile (P90) or any other percentile. In another example, the tool index manager 124 may determine a minimum or lower threshold as a $25^{th}$ percentile (P25), a $10^{th}$ percentile (P10), or any other percentile. The tool index manager may determine the threshold(s) based on a geographic location or application. The tool index manager 124 may determine the expected value in this way for any of a variety of downhole tool indices and for any number of downhole tool indices. The tool index manager 124 may store any of this information to the data storage 130 as tool index data 136.

In some embodiments, the downhole tool indices include a formation stiffness, K. The formation stiffness K may be a measure or estimation for characterizing the mechanical rigidity or stiffness of the formation, or ability of the formation to resist deformation under an applied load. The formation stiffness may be expressed in terms of Young's Modulus or a Bulk Modulus. The formation stiffness K may be a useful metric for understanding the interaction between a downhole tool and the formation, and may facilitate evaluating the wear of a downhole tool as it proceeds through the formation.

The formation stiffness K may be determined by the following formula:

$$K = \frac{WOB}{\left(\frac{ROP}{RPM}\right)}$$

$WOB$ = Weight on Bit $ROP$ = Rate of Penetration $RPM$ = Downhole Tool Rotational Speed or (Rotations per Minute)

The formation stiffness K may be determined in any other way or in accordance with any other formula or principle for characterizing the formation stiffness K. The formation stiffness K may typically be in a range from 0.1-5 Mlbf/in. The tool index manager 124 may determine the formation stiffness K for one or more wellbores and for one or more (or all) measurement depths of interest. The WOB and/or RPM may be measured from downhole sensors, or may be inferred from surface measurements. In some embodiments, priority is given to higher-confidence measurements (e.g., direct or downhole measurements).

In some embodiments, the downhole tool indices include a mechanical specific energy MSE. The MSE may be a measure or estimation of the unit energy needed to degrade, destroy, or otherwise remove a unit of rock of the formation. The MSE may provide insight into the drilling efficiency and energy consumption during drilling operations of a downhole tool.

The MSE may be determined by the following formula:

$$MSE = \frac{WOB}{A_{bit}} + \frac{120 \cdot \pi \cdot RPM \cdot TOR}{ROP \cdot A_{bit}}$$

$WOB$ = Weight on Bit $ROP$ = Rate of Penetration $RPM$ = Downhole Tool Rotational Speed or (Rotations per Minute)

$TOR$ = Torque on Bit $A_{bit}$ = Area of the Bit

The MSE may be determined in any other way or in accordance with any other formula or principle for characterizing the MSE. The tool index manager 124 may determine the MSE for one or more wellbores and for one or more (or all) measurement depths of interest.

In some embodiments, the downhole tool indices include a bit aggressiveness μ. The bit aggressiveness μ may be a measure or estimation of the frictional coefficient between a downhole tool and the formation given the applied weight and torque.

The bit aggressiveness μ may be determined by the following formula:

$$\mu = \frac{36 \cdot TOR}{WOB \cdot D_{bit}}$$

$WOB$ = Weight on Bit $TOR$ = Torque on Bit $D_{bit}$ = Diameter of the Bit

The bit aggressiveness may be determined in any other way or in accordance with any other formula or principle for characterizing the bit aggressiveness μ. The tool index manager 124 may determine the bit aggressiveness μ for one or more wellbores and for one or more (or all) measurement depths of interest.

In some embodiments, the downhole tool indices include a penetration per revolution PPR. The PPR may represent the distance a downhole tool advances through a formation during each revolution of the downhole tool.

The PPR may be determined by the following formula:

$$\frac{ROP}{RPM}$$

$ROP$ = Rate of Penetration $RPM$ = Downhole Tool Rotational Speed or (Rotations per Minute)

The PPR may be determined in any other way or in accordance with any other formula or principle for characterizing the PPR. The tool index manager 124 may determine the PPR for one or more wellbores and for one or more (or all) measurement depths of interest.

In this way, the tool index manager 124 may determine one or more of these downhole tool indices, any other relevant index or metric, for characterizing and/or quantifying the wear of an associated downhole tool.

In some embodiments, the tool index manager 124 determines and monitors one or more of these downhole tool indices for the subject wellbore and/or the subject downhole tool. For example, based on the subject wellbore data 132, the tool index manager 124 may determine (e.g., actively and/or in real time) a subject downhole tool index for the subject wellbore. For instance, the tool index manager 124 may determine an active, current, or real-time formation stiffness (or other downhole tool index) for the subject wellbore based on the real-time subject wellbore data 132. The tool index manager 124 may store the subject downhole tool index information to the data storage 130 as tool index data 136.

As described in further detail below, determining the subject downhole tool index may facilitate evaluating the wear state of the downhole tool. Comparing a subject downhole tool index to an associated expected downhole tool index and/or thresholds of the expected downhole tool index may facilitate conceptualizing the extent or degree of wear of the subject downhole tool based on the characteristic, aspect, or property that the associated downhole tool index represents. For example, an expected formation stiffness $K_{exp}$ may be determined based on various offset wellbores that are similar to the subject wellbore in one or more regards. As discussed above, the offset wellbore data may be filtered to remove offset wellbore data associated with offset downhole tools that exhibited wear to a certain degree. Accordingly, the expected formation stiffness $K_{exp}$ may be determined to a high degree of accuracy, or in other words, with a high degree of confidence that the determined expected formation stiffness $K_{exp}$ accurately represents that the actual stiffness of the formation without being influenced by a dull condition of the offset downhole tools of the underlying data. The tool index manager 124 may determine, in real time, a subject formation stiffness $K_{subj}$ based on the real-time subject wellbore data 132. The subject wellbore data 132 and the offset wellbore data 134 may be aligned based on the formation such that the expected formation stiffness $K_{exp}$ may represent the actual formation stiffness of the formation at the location within the formation where the subject downhole tool is currently positioned. By comparing the subject formation stiffness $K_{subj}$ to the expected formation stiffness $K_{exp}$ the wear state of the subject downhole tool may be discerned. For example, the subject formation stiffness $K_{subj}$ being observed to increase above what is expected may signal that the subject downhole tool is becoming or has become worn (e.g., as opposed to signaling that the formation stiffness is increasing, which may be known not to be the case based on the high confidence of the expected formation stiffness $K_{exp}$).

A similar methodology may follow with respect to any of the downhole tool indices described herein. For example, a subject mechanical specific energy, $MSE_{subj}$ being observed to increase above an expected mechanical specific energy $MSE_{exp}$ may indicate that more energy is being utilized to remove an equivalent unit of rock of the formation, which may signal that the bit is becoming dull (e.g., as opposed to signaling that the rock is becoming harder). In another example, a subject bit aggressiveness $\mu_{subj}$ being observed to decrease below an expected bit aggressiveness exp may indicate that the friction between the subject downhole tool and the formation has decreased. This may accordingly signal that the subject downhole tool is encountering less frictional resistance from the formation due to a dull bit, as opposed to the formation becoming harder for example. In another example, a subject penetration per revolution $PPR_{subj}$ being observed to decrease below an expected penetration per revolution $PPR_{exp}$ may indicate that the subject downhole tool is progressing through the formation less per each revolution. This may accordingly signal that the subject downhole tool is struggling more to remove material from the formation due to a dull bit, as opposed to the formation becoming harder for example. In this way, the downhole tool indices described herein (or any other index), when comparing a subject index to an expected index, may facilitate characterizing and/or quantifying the state of wear of the subject downhole tool based on the different properties that the respective downhole tool indices represent.

In some embodiments, the tool index manager 124 determines an index ratio (IR) of a subject downhole tool index to a corresponding expected downhole tool index. For example, the tool index manager 124 may determine an IR for the formation stiffness as a ratio of the subject formation stiffness to the corresponding expected formation stiffness (e.g., a formation stiffness ratio FSR as referred to herein). The tool index manager 124 may determine an IR for any of the downhole tool indices described herein. The IR in this way may facilitate comparing the subject downhole tool indices to the corresponding expected downhole tool indices. For example, while it may be useful to view and compare values and/or plotted representations of the subject downhole tool indices and expected downhole tool indices (e.g., side-by-side), the IR may provide a quantified representation of this comparison.

In some embodiments, the tool index manager 124 classifies the IR (and accordingly classifies the wear of the subject downhole tool) based on one or more predetermined thresholds for the IR. For example, FIG. 4 illustrates example thresholds for the formation stiffness ratio FSR. The same or similar classifications may be established and implemented for any IR for any downhole tool index. As shown, potential FSR values may be divided into several categories or classifications. An FSR from 0 to 2 may be a low classification for the FSR. An FSR larger than 3.5 may be a severe classification for the FSR. As shown, there may also be one or more intermediate classifications, such as medium and/or high, for the FSR. The classifications for the FSR may be determined based on historical data from (e.g., geographically close) offset wellbores and/or from selected wellbores from a similar application (e.g., if no close offset wellbores are available). The tool index manager 124 may determine and/or classify the FSR for any (or all) measurement depths of the subject wellbore, including an active measurement depth. For example, the tool index manager 124 may determine and update the FSR and associated classification in real time and during drilling to provide an accurate and active representation of the wear state of the subject downhole tool. The FSR in this way may provide a simple and intuitive indication of the level or severity of wear of the subject downhole tool.

In some embodiments, the classifications for the FSR correspond to a rating index or rating system. For example, as shown, a first or low classification may correspond to a rating of 0 for the FSR, a next classification may correspond to a rating of 1, and so on. The tool index manager 124 may determine and/or associate the FSR ratings to facilitate one or more functionalities of the wear detection system 120 as described herein. The FSR rating scale and associated classifications may include any other ratings and/or may be formulated in any other way.

The wear detection system 120 has, to this point, been described primarily with respect to one or more downhole tool indices for a subject downhole tool that may be useful for comparing against expected values. For example, the value of a subject downhole tool index may be compared against a corresponding value of an expected downhole tool index at an associated measurement depth and/or moment in time in order to characterize the wear of the subject downhole tool. In this way, the downhole tool indices described above may provide a comparison, for example, at a snapshot in time (e.g., live and/or historical) of the subject wellbore data 132 and the offset wellbore data 134.

In some embodiments, it may be advantageous to cumulatively conceptualize and/or quantify the wear of a downhole tool with respect to a total wear of a bit over many data points, measurement depths, and/or moments in time. In some embodiments, the tool index manager 124 determines a cumulative wear index (CWI) for the subject downhole tool. The CWI may represent the wear of the subject downhole tool based on associating determined level(s) of wear of the downhole tool (e.g., based on one or more of the downhole tool indices) to a number of revolutions of the downhole tool at the associated level(s) of wear. For example, the CWI may be expressed as equivalent cumulative bit damage revolutions, and may be based on or associated with a determined formation stiffness at one or more (or all) previous measurement depths uphole of an active measurement depth. The CWI may incorporate an RPM and ROP of the subject downhole tool at each measurement depth. The CWI may incorporate an expected formation stiffness at each measurement depth. The expected formation stiffness may be normalized based on a normalization factor. The CWI may incorporate a rating or classification of the FSR, for example, expressed as a value between 0 and 3 (or any other scale). The CWI may be determined by the following formula:

$$CWI = \sum_{i=1}^{n} \frac{\Delta MD_i \cdot RPM_i \cdot 60 \cdot \text{FSR_RI}_i}{ROP_i} \cdot \frac{FS_i}{\text{FS_norm_factor}}$$

$i$ = Summation Index n=Total number of Active Measurement Depths

AMD=Change in Measurement Depth from Previous Summation Index

RPM=Downhole Tool Rotational Speed or (Rotations per Minute)

FSR_RI=Formation Stiffness Ratio Rating (in the normalized scale)

FS=Expected Formation Stiffness based on offset data

FS_norm_factor=Normalization Factor to compute the relative formation stiffness

Additionally, or alternatively, the CWI may be determined by the following formula, with similar parameter definitions as above:

$$CWI = \sum_{i=1}^{n} \frac{\Delta MD_i \cdot RPM_i \cdot 60 \cdot FSR_{RI_i}}{ROP_i} \cdot e^{\frac{FS_i}{FS_norm_factor}}$$

The CWI may be determined in any other way or in accordance with any other formula or principle for characterizing the CWI. For example, while the CWI is described specifically with respect to the formation stiffness and the FSR, in some embodiments, the CWI is determined with respect to one or more other downhole tool indices, for example, in addition to or in place of the formation stiffness. The tool index manager 124 may determine and/or update the CWI in real time and while drilling in order to provide a live indication of the CWI.

The CWI may represent a cumulative or totality of the wear of the subject downhole tool over some or all of the measurement depths of the subject wellbore. For example, the CWI may relate the determined level or classification of wear (e.g., rating of the FSR as described in connection with FIG. 4) to a number of revolutions that the downhole tool has completed while being observed to have that rating/classification of wear. The CWI may be a summation of a plurality of non-negative values such that the CWI, over time, may only stay constant or increase. This may be consistent with the real-world behavior of the wear of downhole tools, which may, for a time, be constant and relatively low, but over time may wear to a further and further degree. As shown in FIG. 4, the rating associated with the lowest (e.g., acceptable) FSR classification may be 0, and the CWI (e.g., due to the FSR_RI term) may also be 0 while the subject downhole tool is being observed at or within the lowest wear classification (e.g., a summation of trivial or zero-value terms). As the determined FSR classification/rating becomes non-zero (e.g., medium, high, or severe) based on the underlying subject formation stiffness exceeding the expected formation stiffness, the CWI may account for a number of revolutions in which the downhole tool is observed with this non-zero wear classification. Accordingly, the CWI calculation may include a sum of one or more non-zero iterations representative of these revolutions at non-trivial (e.g., medium, high, or severe) levels of wear. In this way, the CWI may, over time, increase based on instances of an elevated FSR, but the level of increase may be dependent on an associated amount of revolutions of the downhole tool.

In this way, the CWI may provide a more detailed characterization of the wear of the subject downhole tool than, for example, the downhole tool indices discussed above. For example, the IR of the downhole tool indices discussed above may provide a valuable, but simple, comparison of subject (e.g., actual) vs. expected values at a snapshot in time, but the CWI may provide a more detailed characterization by accounting for how long the subject downhole tool interacts with the formation at above-expected index values. In some embodiments, the CWI is more reliable and/or stable by showing wear over time. For example, due to the downhole tool indices being associated with a specific moment in time, data quality issues, depth/formation alignment issues, etc., of the offset wellbore data 134 and/or the subject wellbore data 132 may result in spikes or sudden increases in the IR between actual and expected values (as described below in connection with FIG. 8). It may be difficult to discern whether these spikes are due to such data issues or if they are truly indicative of wear of the subject downhole tool. The CWI, however, may not be as susceptible to misalignment or data quality issues, as a sudden spike in the IR, even if large, may only slightly increase the CWI based on an associated number of revolutions being relatively small. Thus, the CWI may more accurately reflect the actual wear of the subject downhole tool due to the time element of the CWI and based on the CWI being cumulative of all identified wear over a (e.g., large) range of operational time of the subject downhole tool.

As mentioned above, the CWI may incorporate a normalization factor for normalizing the expected formation stiffness. The normalization factor may be representative of a typical (e.g., average) formation stiffness observed for relevant or similar wellbores generally, such as at all measurement depths and/or throughout all formations or subterranean layers. For example, the normalization factor may be based on a set of offset wellbores, such as the offset wellbores of offset wellbore data 134; offset wellbores within a geographical distance from the subject wellbore; offset wellbores in a same oilfield, basin, region, formation, or location as the subject wellbore; offset wellbores within a global database; or any other collection of offset wellbores. The normalization factor may be an average, median, or percentile of all the formation stiffnesses (at all measurement depths) observed throughout the associated relevant offset wellbores. In this way, the normalization factor may be a global statistic representative of a typical formation stiffness for any wellbore generally and at any location and/or measurement depth. The normalization factor may be expressed as a single value, a polynomial, an exponential, or any other suitable expression in order to measure the relative level of the expected formation stiffness as described herein.

The normalization factor may be useful for determining how the expected formation stiffness (e.g., at a specific measurement depth) compares to the typical or average stiffness of the formation or earth generally for the subject wellbore at any measurement depth. For example, the expected formation stiffness at a given measurement depth may be determined to be higher than normal if the expected formation stiffness is greater than the normalization factor. Similarly, the expected formation stiffness at a given measurement depth may be determined to be lower than normal if the expected formation stiffness is less than the normalization factor. This comparison may be implemented for weighting the expected formation stiffness in the calculation of the CWI. For example, as seen in the formula above, the expected formation stiffness may be inversely weighted (e.g., divided) by the normalization factor. This may have the effect of weighting down instances of the expected formation stiffness being lower than normal such that, when summed, these instances increase the cumulative wear to a lesser degree. Similarly, instance of the expected formation stiffness being higher than normal may be weighted up such that, when summed, these instances increase the cumulative wear to a greater degree. The CWI may be determined in this way to reflect the concept that, even given signs of wearing (e.g., elevated FSR) of the downhole tool at a given measurement depth, if the expected formation stiffness is less than normal at that specific measurement depth (e.g., the formation is softer than normal) the subject downhole tool may wear to a lesser degree in the softer-than-normal formation. The CWI may accordingly be determined by weighting such instances lower. Similarly, if the expected formation stiffness is higher than normal at a specific measurement depth (e.g., the formation is harder than normal) the subject downhole tool may wear to a greater degree in the harder-than-normal formation. The CWI may accordingly be determined by weighting such instances higher.

In some embodiments, the tool index manager 124 classifies the CWI based on one or more predetermined thresholds for the CWI. For example, FIG. 5 illustrates example thresholds for the CWI. As shown, an observed CWI value may be classified into several different categories or classifications. A CWI between 0 and 10,000 revolutions may be a minimum, low, or acceptable classification for the CWI. A CWI over 30,000 revolutions may be a maximum, or severe classification for the CWI. As shown, there may also be one or more intermediate classifications, such as medium and/or high, for the CWI. The tool index manager 124 may classify the CWI based on any thresholds or categories consistent with that described herein. The tool index manager 124 may determine and/or classify the CWI for any (or all) measurement depths of the subject wellbore, including an active measurement depth. For example, the tool index manager 124 may determine and update the CWI and associated classification in real time and during drilling to provide an accurate and active representation of the wear state of the subject downhole tool. The CWI in this way may provide a comprehensive and intuitive indication of the level of severity of wear of the subject downhole tool.

In some embodiments, the tool index manager 124 determines one or more summary statistics. The summary statistics may be values, metrics, and/or indications that represent a general property or aspect of the subject wellbore and/or the offset wellbores, for example, at a high level. For example, the summary statistics may include an indication of footage. Based on the offset wellbore data 134, the tool index manager 124 may determine a footage, or a total drilled distance, associated with a downhole tool of each offset wellbore. The tool index manager 124 may accordingly determine an average, median, or any other statistical calculation, of the footage values for all of the offset wellbores of the offset wellbore data 134. In this way, the footage summary statistic may give a simple, high-level summary of, for example, what footage the subject downhole tool may be expected to achieve. The tool index manager 124 may determine, in this manner, summary statistics for any other relevant aspect, parameter, or property, such as a rate of penetrations, a CWI, FSR, IR, ROP, etc.

As mentioned above, the wear detection system 120 includes a report engine 126. The report engine 126 may generate one or more reports. In some embodiments, the report engine 126 displays one or more of the reports via a graphical user interface of a user device.

Figure 6:
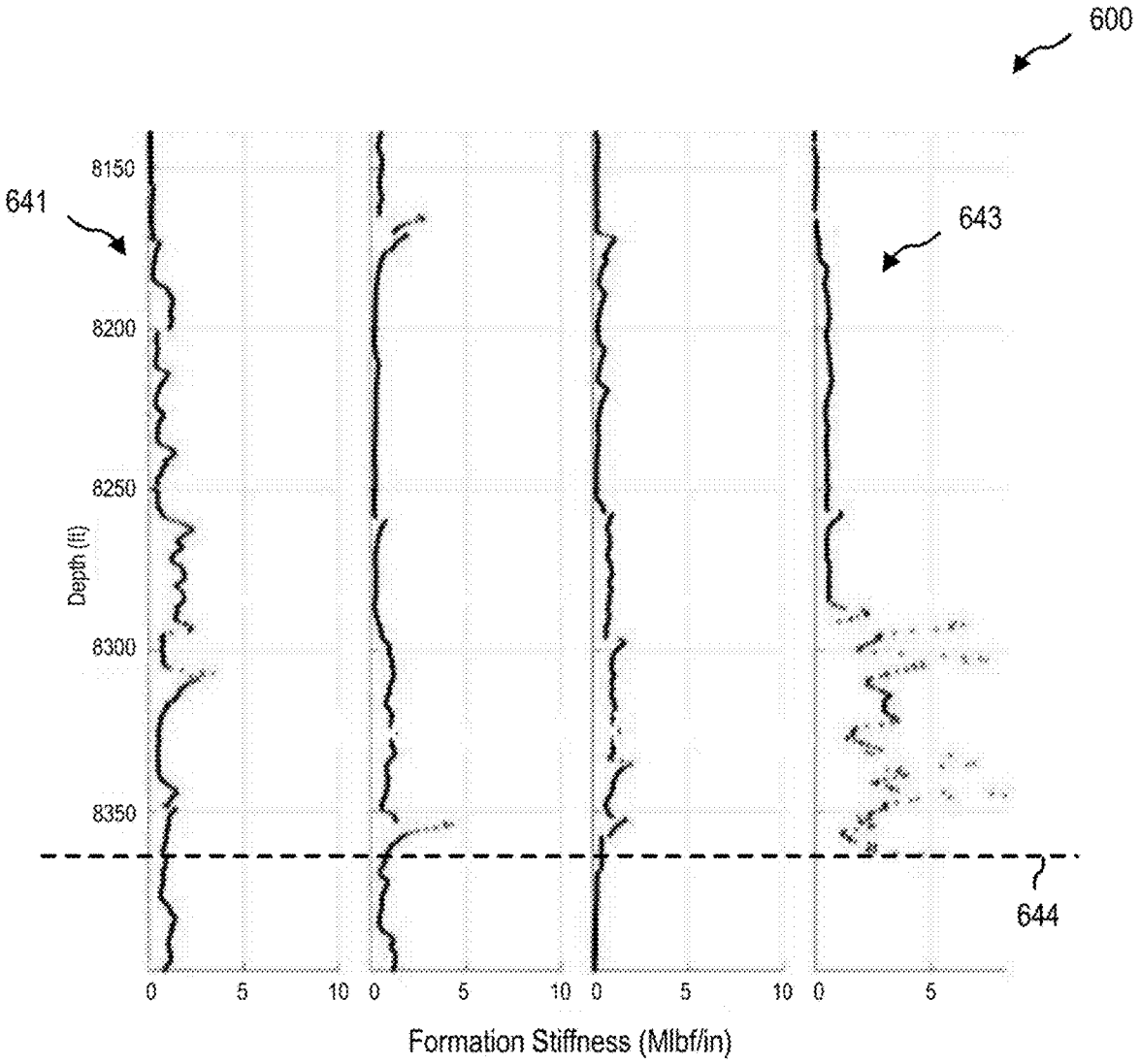
FIG. 6 illustrates a report generated by a report engine, according to at least one embodiment of the present disclosure.

FIG. 6 illustrates an example report 600 generated by the report engine 126, according to at least one embodiment of the present disclosure. In some embodiments, the report 600 represents one or more of the downhole tool indices described herein for the offset wellbores and/or the subject wellbore. For example, the report 600 illustrates the formation stiffnesses 641 determined for several offset wellbores 640, as well as the subject formation stiffness 643 for a subject wellbore 642. The report 600 may include one or more other downhole tool indices in addition to or in place of the formation stiffness. The report 600 may indicate the formation stiffnesses 641 for the offset wellbores 640 through a range of measurement depths, such as from 8150 ft to about 8400 ft as shown. The report 600 may indicate the subject formation stiffness 643 for the subject wellbore 642 in real time. For example, the report 600 may indicate an active measurement depth 644 for the subject wellbore 642, and may indicate the real-time subject formation stiffness 643 at the active measurement depth 644. The report 600 may indicate the subject formation stiffness 643 at one or more other measurement depths prior to or uphole of the active measurement depth 644. The report engine 126 may update or regenerate the report 600 continually and/or periodically to represent the active or current value of the subject formation stiffness 643.

The report 600 may facilitate comparing the values of one or more downhole tool indices of a subject wellbore to those calculated or observed in one or more offset wellbores. This side-by-side comparison may facilitate determining when the subject downhole tool becomes worn. For example, as shown, the determined formation stiffnesses 641 of each of the offset wellbores 640 appears consistently between about 1 and 3 Mlbf/in through the range of measurement depths. Additionally, the determined formation stiffness 641 of each of the offset wellbores 640 appears relatively continuous throughout the range of measurement depths shown. However, the subject formation stiffness 643 of the subject wellbore 642 from about 8290 ft and beyond begins to be elevated above that of the offset wellbores 640, to about 2-8 Mlbf/in. Additionally, the subject formation stiffness 643 is observed to be significantly more disjointed and fragmented than that of the offset wellbores 640. Accordingly, these data features of the subject formation stiffness 643 of the subject wellbore 642 made evident through comparison with the formation stiffnesses 641 of the offset wellbores 640 may indicate that the subject downhole tool has become worn, damaged, or both. In this way, the report 600 may facilitate identifying a wear state of the subject downhole tool.

The report engine 126 may store the report 600 to the data storage as report data 138. In some embodiments, the report engine 126 presents the report 600 via a graphical user interface of a user device.

Figure 7:
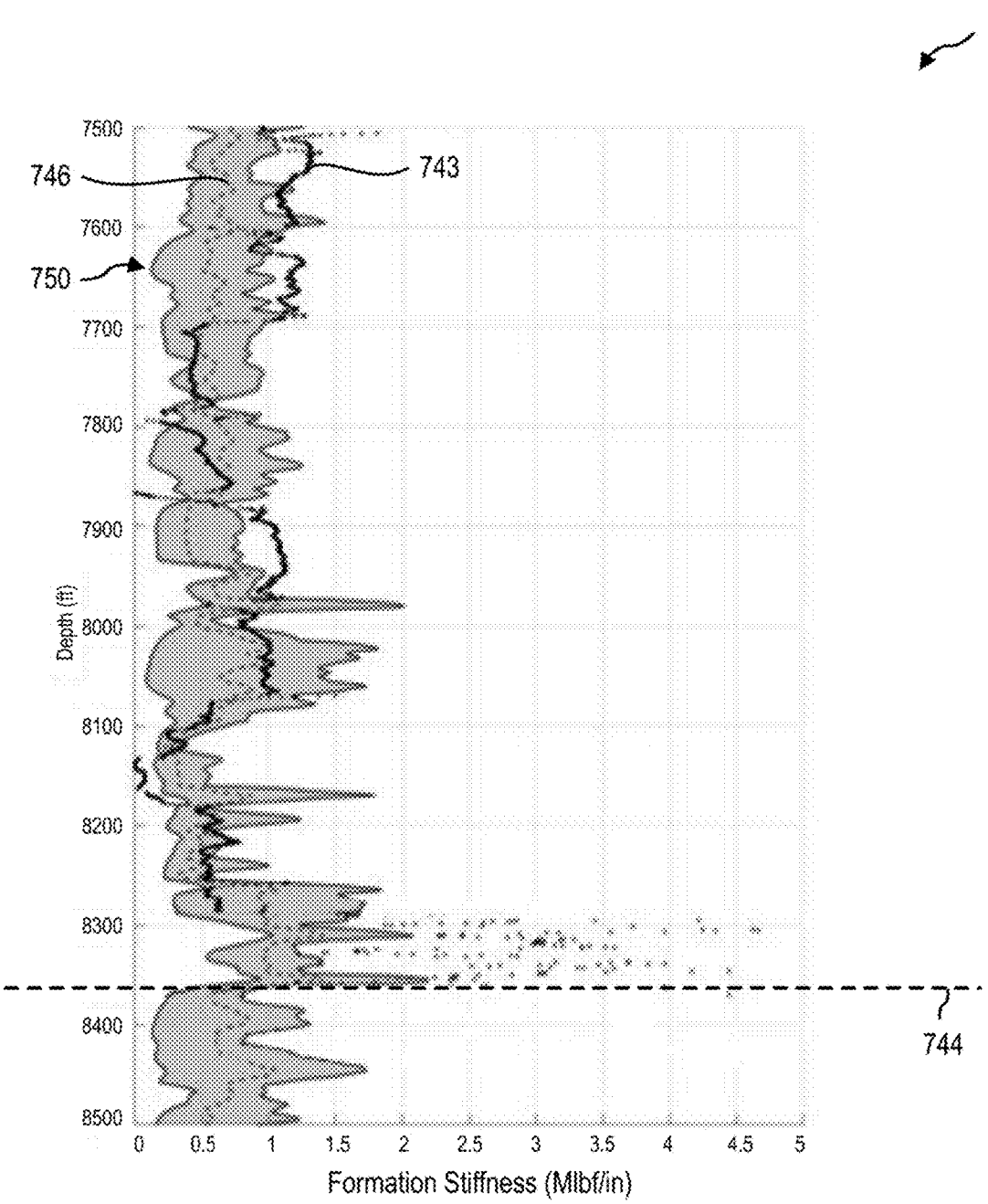
FIG. 7 illustrates a report generated by a report engine, according to at least one embodiment of the present disclosure.

FIG. 7 illustrates an example report 700 generated by the report engine 126, according to at least one embodiment of the present disclosure. The report 700 may indicate or represent an expected downhole tool index 746 as described herein. For example, the expected downhole tool index 746 may be an expected formation stiffness. The report 700 may indicate or represent a corresponding subject downhole tool index 743, such as a subject formation stiffness. The report 700 may indicate one or more thresholds 750 or boundaries for the expected downhole tool index 746. The thresholds 750 may be a maximum and/or minimum, a range of percentiles, standard deviations, or any other threshold or boundary for or based on the expected downhole tool index 746. The report 700 may illustrate the subject downhole tool index 743 at an active measurement depth 744. The report engine 126 may update and/or regenerate the report 700 in order to represent the subject downhole tool index 746 in real time and while drilling as the active measurement depth 744 advances downward through a formation. The report 700 may include one or more other downhole tool indices and associated thresholds in addition to or in place of the formation stiffness.

In this way, the report 700 may illustrate the subject downhole tool index 743 with respect to the expected downhole tool index 746 and/or the thresholds 750 in order to provide a useful comparison to gauge the observed value of the subject downhole tool index 743. For example, as shown, from about 8290 ft and beyond, the subject downhole tool index 743 is observed as exceeding both the expected downhole tool index 746 and the threshold 750 one or more times. Additionally, the subject downhole tool index 743 is observed as becoming fragmented and disjointed. In this way, the report 700 may indicate that the subject downhole tool has become dull and/or damaged.

The report engine 126 may store the report 700 to the data storage as report data 138. In some embodiments, the report engine 126 presents the report 700 via a graphical user interface of a user device.

Figure 8:
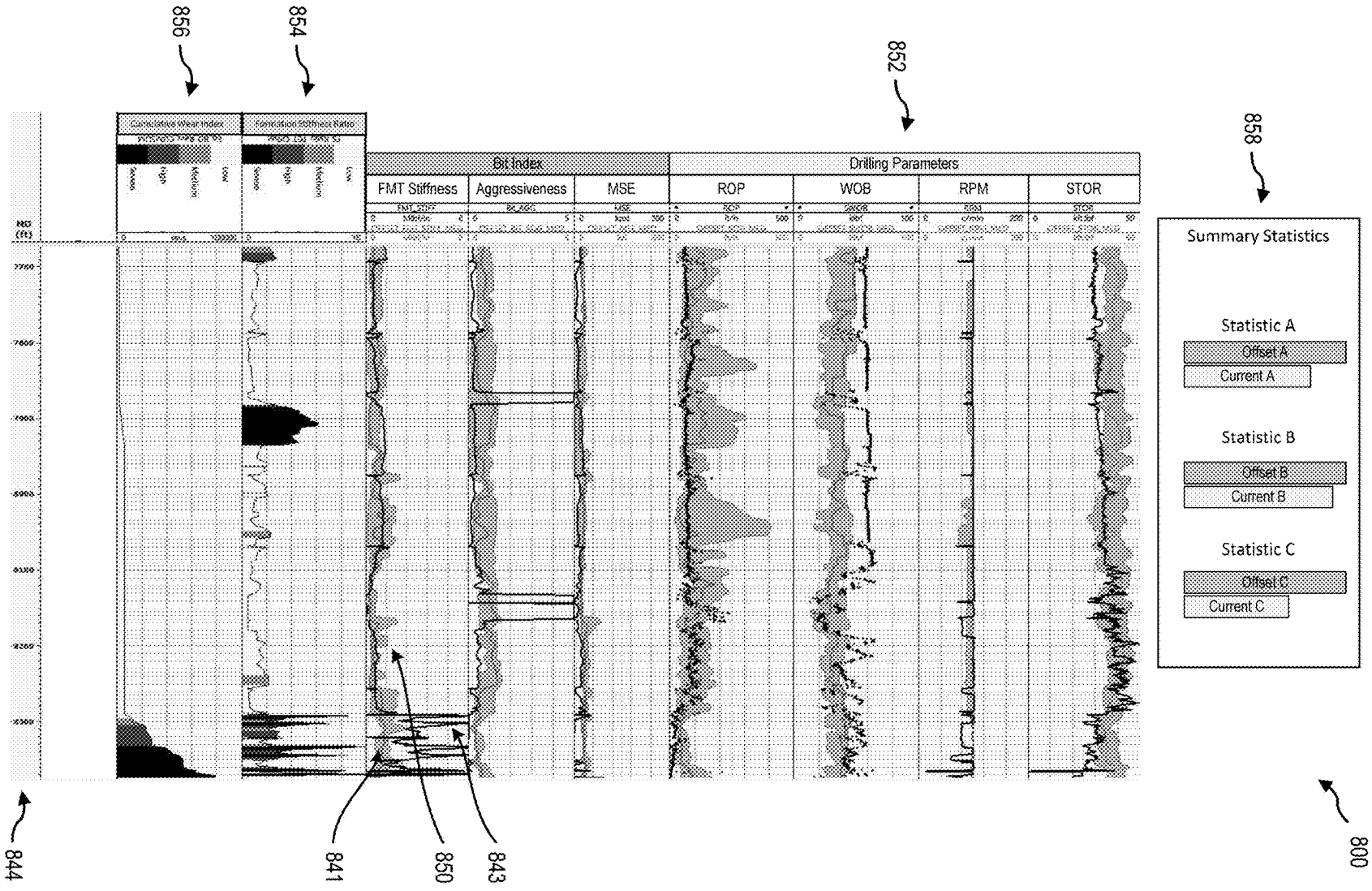
FIG. 8 illustrates a report generated by a report engine, according to at least one embodiment of the present disclosure.

FIG. 8 illustrates an example report 800 generated by the report engine 126, according to at least one embodiment of the present disclosure. Similar to that discussed in connection with FIG. 7, the report 800 may indicate or represent one or more subject downhole tool indices 843, expected downhole tool indices 841 and/or thresholds 850. The report 800 may indicate these metrics for any number of downhole tool indices as discussed herein, such as the formation stiffness, bit aggressiveness, MSE, or PPR, or any other index. The report 800 may indicate one or more measurement depths of the subject wellbore, including at an active measurement depth 844. In this way, the report 800 may facilitating evaluating one or more of the subject downhole tool indices 843, for example, against the expected downhole tool indices 841 and/or thresholds 850.

In some embodiments, the report 800 indicates one or more drilling parameters 852. For example, the report 800 may indicate, for the range of measurement depths, a ROP, WOB, RPM, torque (TOR), or any other parameters associated with the subject downhole tool and/or the subject wellbore. In some embodiments the report 800 indicates one or more statistical values and/or ranges associated with the drilling parameters 852. For example, the report 800 may indicate an average, median, etc., for the drilling parameters based on the offset wellbore data 134. The report 800 may indicate one or more boundaries for the drilling parameters 852, such as a maximum and/or minimum, quartile range, standard deviation range, a range of percentiles, or any other boundaries. These statistics may be determined by the tool index manager 124 based on the offset wellbore data 134. In this way, the report 800 may facilitate comparing one or more drilling parameters of the subject wellbore to those implemented by the offset wellbores.

In some embodiments, the report 800 indicates an IR of one or more of the subject downhole tool indices to an associated expected downhole tool index. For example, the report 800 may plot an FSR 854 for the subject wellbore throughout the range of measurement depths. The plot of the FSR may provide a visual representation of both the active (e.g., at the active measurement depth 844) and historical values of the FSR. In this way, the FSR may be monitored in order to facilitate determining and conceptualizing a level of wear of the subject downhole tool. In some embodiments, the report 800 indicates a classification or rating of the FSR as described herein. For example, a color code or scale (or any other suitable technique) may indicate the classifications of the FSR, such as from low to severe. As shown, the FSR may exhibit one or more increases corresponding to deviations of the underlying subject formation stiffness from the expected formation stiffness. The increases may be exhibited as spikes or peaks, or may be smaller or more subtle increases. The report 800 may indicate the increases in the FSR with an associated color (or other indication) of the classification, indicating the extent of the increase. In this way, the report 800 may facilitate identifying instances of the subject formation stiffness (e.g., via the FSR) that may be indicative of wear of the subject downhole tool.

In some embodiments, the report 800 indicates a CWI 856 for the subject downhole tool as described herein. For example, the report 800 may plot the CWI for the subject wellbore throughout the range of measurement depths. The plot of the CWI may provide a visual representation of both the active (e.g., at the active measurement depth 844) and historical values of the CWI. The report 800 may indicate a classification or rating of the CWI as described herein. For example, a color code or scale (or any other technique) may indicate the classifications of the CWI, such as from low to severe. The classification of wear levels may be determined based on historical data from similar and/or geographically close offset wellbores. For example, CWI may be calculated for related offset wellbores both with and without severe wear levels in order to determine reference levels for the classification. As shown, the CWI may grow or increase over time, consistent with the increase of wear of the subject downhole tool over time. The report 800 may indicate the classification of the CWI by incorporating the associated color (or other indication) of the classification into the plot of the CWI as the CWI advances to increasing wear levels of the classification.

As mentioned above, the CWI may not be as susceptible to misalignment or data quality issues as, for example, the FSR. The example data of the report 800 illustrates this. For example, at about 7900 ft, the FSR exhibits a significant spike for about 100 ft. The report 800 indicates the spike is classified as severe. Based on the FSR alone, this spike may indicate that the subject downhole tool is damaged or worn and may need to be removed from the subject wellbore. The corresponding CWI value at around 7900 ft, however, indicates that the cumulative wear of the subject downhole tool is still relatively low, and classified as a low level. As mentioned above, the spike and/or high levels of the FSR may factor into the computation of the CWI, but the relatively short span of the spike (e.g., around 100 ft of nearly 8000 total drilled feet) and accordingly the relatively low number of revolutions of the downhole tool results in only a small increase in the CWI, as shown. Additionally, the expected formation stiffness may be observed to be relatively low at 7900 ft, which further reduces the effect of the spike on the CWI, as discussed above. Thus, the CWI may be a more accurate measure of the wear of the subject downhole tool, as based on the FSR alone, it may appear that the subject downhole tool was worn to a severe degree at 7900 ft, when in fact the subject downhole tool may not have reached such a severe wear state for another 400 or more feet, as shown by the CWI. The spike may accordingly indicate a data alignment issue of the subject wellbore data 132 and the offset wellbore data 134, for example, rather than the subject downhole tool becoming worn.

In some embodiments, the report 800 indicates one or more summary statistics 858 for the subject downhole tool as described herein. The summary statistics 858 may indicate one or more top-level or high-level properties or values for comparing the performance of the subject downhole tool to the offset downhole tools of the offset wellbores. The summary statistics 858 in this way may provide a simple and accessible evaluation of one or more aspects of the subject wellbore, for example, in contrast to the more detailed information included in other parts of the report 800.

The report engine 126 may store the report 800 to the data storage as report data 138. In some embodiments, the report engine 126 presents the report 800 via a graphical user interface of a user device.

Figure 9:
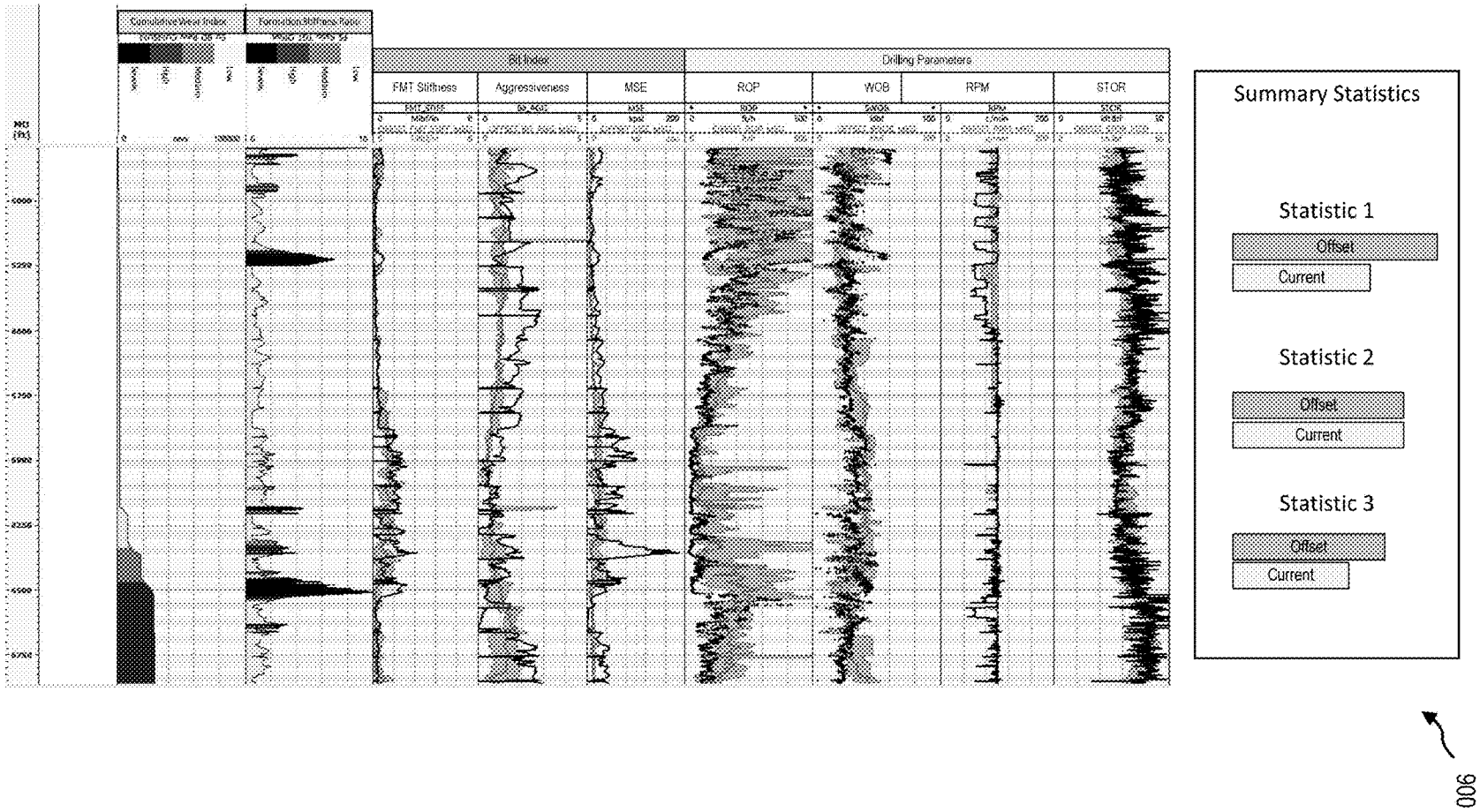
FIG. 9 illustrates a report generated by a report engine, according to at least one embodiment of the present disclosure.

FIG. 9 illustrates an example report 900 generated by the report engine 126. The report 900 may include any of the features discussed above in connection with the report 800 of FIG. 8, but, for example, based on a different set of example data.

In some embodiments, the report engine 126 facilitates identifying that the subject downhole tool has become worn or damaged. For example, based on, or in connection with, any of the reports discussed herein, the report engine 126 may monitor one or more values, metrics, indices, etc., and may generate a flag or alert. For example, the report engine 126 may monitor a subject downhole tool index against an associated expected downhole tool index and/or one or more associated thresholds in order to identify that the subject downhole tool index has surpassed or exceeded one or more of these values. In another example, the report engine 126 may monitor an IR (such as the FSR) to identify when it surpasses a certain value. In another example, the report engine 126 may monitor a CWI against one or more predetermined categories or classifications in order to identify that the CWI changes classifications or reaches a certain classification. The report engine 126 may monitor any value, metric, or index in order to make any relevant determination consistent with that described herein. The report engine 126 may monitor one or more metrics in this way and may generate an alert based on one or more criteria. For example, the alert may be based on a metric surpassing a (e.g., expected) value or threshold (or both). In another example, the alert may be based on a metric surpassing a value to a certain degree, or for a certain amount of time (or distance), or a combination of both. In another example, the alert may be based on a metric being classified as a given category or classification, or based on a metric changing classifications. In another example, the report engine 126 may generate the alert based on a consideration of how much of the subject wellbore is left to drill, or how far from a target the subject wellbore is. For example, the alert may signal to an operator of the downhole system that the subject downhole tool is worn and should be removed and/or replaced. However, in some situations, if the subject wellbore is near completion it may be advantageous to complete drilling of the wellbore with the subject downhole tool despite the wear condition and despite the potential damage to the subject downhole tool. Accordingly, the report engine 126 may incorporate a consideration of remaining drilling distance into the determination to generate an alert.

The report engine 126 may alert a user of the wear detection system 120. For example, the report engine 126 may present an alert or flag to a user via a graphical user interface of a user device, or may otherwise alert the user. In some embodiments, the report engine 126 facilitates implementing a change to the operation of the downhole system. For example, the report engine 126 may alert a user of the wear state of the subject downhole tool in order that one or more drilling parameters may be adjusted. In some embodiments, the report engine 126 facilitates adjusting one or more drilling parameters based on an identified flag or alert. For example, the report engine 126 may suggest an adjustment to a user, provide information to one or more additional systems regarding the wear state of the subject downhole tool, automatically adjust one or more drilling parameters, stop an operation of the downhole system, or any other action for adjusting the drilling parameters and combinations thereof.

Figure 10:
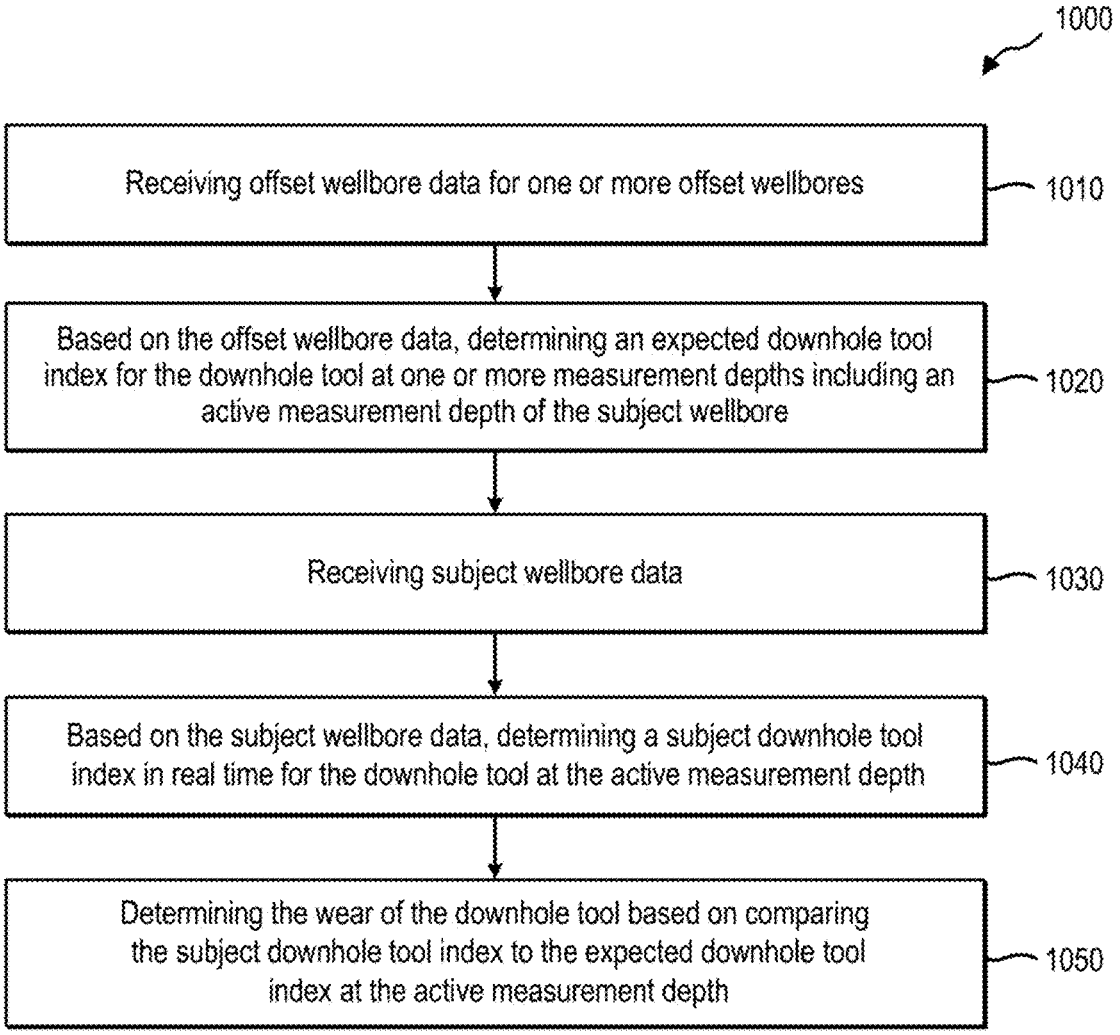
FIG. 10 illustrates a method or a series of acts for determining wear of a downhole tool implemented in a subject wellbore as described herein, according to at least one embodiment of the present disclosure.

FIG. 10 illustrates a flow chart for a method 1000 or a series of acts for detecting wear of a downhole tool implemented in a subject wellbore as described herein, according to at least one embodiment of the present disclosure. While FIG. 10 illustrates acts according to one embodiment, alternative embodiments may add to, omit, reorder, or modify any of the acts of FIG. 10.

In some embodiments, the method 1000 includes an act 1010 of receiving offset wellbore data for one or more offset wellbores. For example, the offset wellbore data may include a rate of penetration, weight on bit, and rotational speed associated with each offset wellbore. In some embodiments, the wear detection system 120 filters out one or more offset wellbores based on a wear condition of a downhole tool of the associated offset wellbores. In some embodiments, the offset wellbore data is based on associated offset wellbores that are in a same formation and/or are at a same depth as the subject wellbore.

In some embodiments, the method 1000 includes an act 1020 of, based on the offset wellbore data, determining an expected downhole tool index for the downhole tool at one or more measurement depths including an active measurement depth of the subject wellbore. For example, the expected downhole tool index may be an expected formation stiffness of the subject wellbore at one or more measurement depths based on the offset wellbore data. The expected downhole tool index may be a median downhole tool index based on the offset wellbore data. In another example, the expected downhole tool index may be an expected mechanical specific energy of a formation, an expected bit aggressiveness of the downhole tool, or an expected penetration per revolution of the downhole tool, based on the offset wellbore data.

In some embodiments, the method 1000 includes an act 1030 of receiving subject wellbore data.

In some embodiments, the method 1000 includes an act 1040 of, based on the subject wellbore data, determining a subject downhole tool index in real time for the downhole tool at the active measurement depth.

In some embodiments, the method 1000 includes an act 1050 of determining the wear of the downhole tool based on comparing the subject downhole tool index to the expected downhole tool index at the active measurement depth. In some embodiments, the wear detection system 120 aligns the subject wellbore data with the offset wellbore data based on a depth of the formation. In some embodiments, the wear detection system 120 classifies the determined wear of the downhole tool based on one or more predetermined thresholds for the subject downhole tool index. In some embodiments, the wear detection system determines a downhole tool index ratio of the subject downhole tool index to the expected downhole tool index.

In some embodiments, the method 1000 includes generating a plot representing the expected downhole tool index and the subject downhole tool index. In some embodiments, the plot represents the downhole tool index ratio. In some embodiments, the method 1000 includes adjusting one or more drilling parameters based on the determined wear of the downhole tool.

Figure 11:
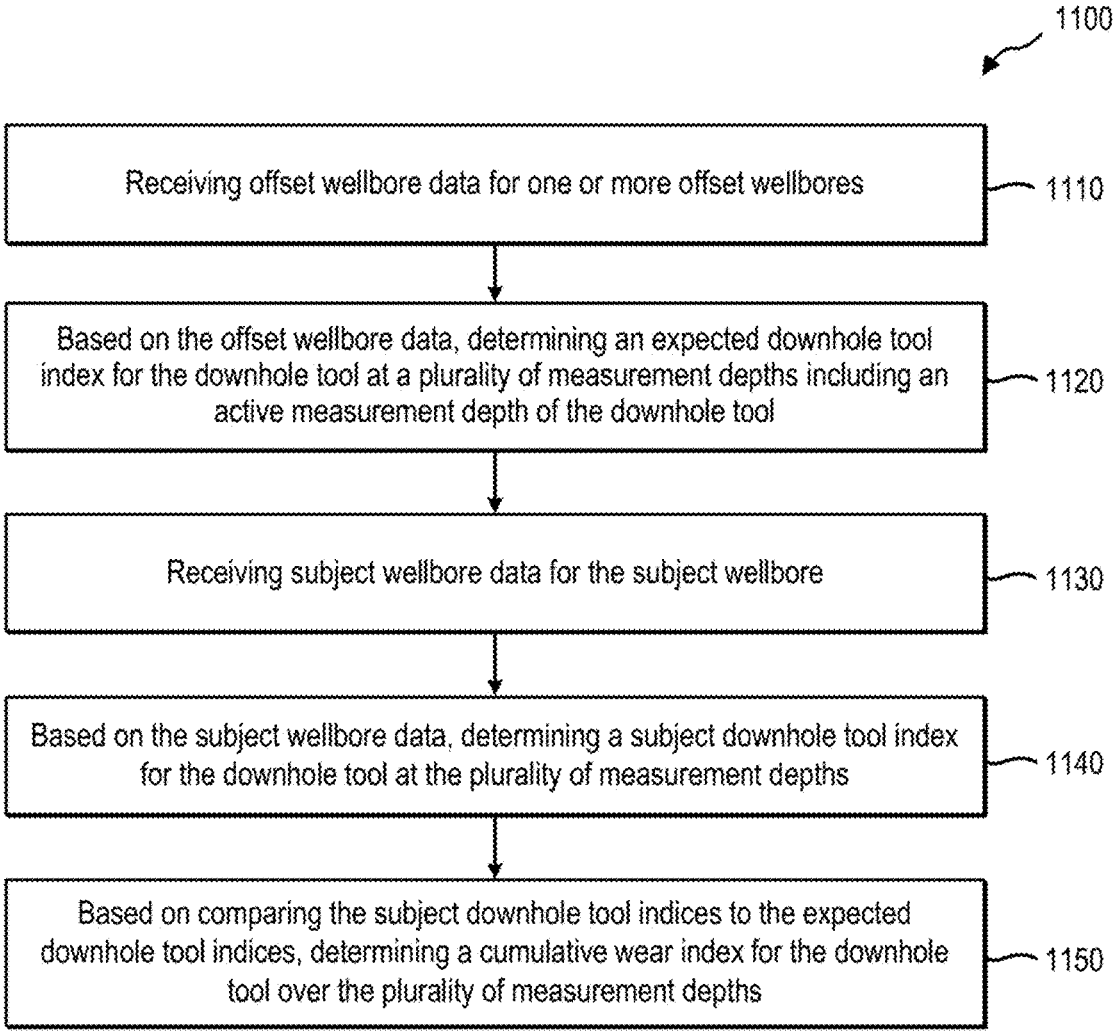
FIG. 11 illustrates a method or a series of acts for determining wear of a downhole tool implemented in a subject wellbore as described herein, according to at least one embodiment of the present disclosure.

FIG. 11 illustrates a flow chart for a method 1100 or a series of acts for detecting wear of a downhole tool implemented in a subject wellbore as described herein, according to at least one embodiment of the present disclosure. While FIG. 11 illustrates acts according to one embodiment, alternative embodiments may add to, omit, reorder, or modify any of the acts of FIG. 11.

In some embodiments, the method 1100 includes an act 1110 of receiving offset wellbore data for one or more offset wellbores.

In some embodiments, the method 1100 includes an act 1120 of, based on the offset wellbore data, determining an expected downhole tool index for the downhole tool at each of a plurality of measurement depths including an active measurement depth of the downhole tool.

In some embodiments, the method 1100 includes an act 1130 of receiving subject wellbore data for the subject wellbore. For example, the subject wellbore data may include rotation data for the downhole tool.

In some embodiments, the method 1100 includes an act 1140 of, based on the subject wellbore data, determining a subject downhole tool index for the downhole tool at each of the plurality of measurement depths.

In some embodiments, the method 1100 includes an act 1150 of, based on comparing the subject downhole tool indices to the expected downhole tool indices, determining a cumulative wear index for the downhole tool over the plurality of measurement depths. For example, the cumulative wear index may associate the comparison of the subject downhole tool indices and the expected downhole tool indices to a rotation of the downhole tool based on the rotation data. For instance, the cumulative wear index may identify a number of revolutions of the downhole tool with respect to the subject downhole tool indices as compared to one or more threshold ranges of the expected downhole tool indices. In some embodiments, the wear detection system 120 classifies the determined cumulative wear index based on one or more predetermined thresholds. In some embodiments, the wear detection system 120 determines a normalization factor for a formation of the one or more offset wellbores and of the subject wellbore. The cumulative wear index may be determined based on normalizing the expected downhole tool index based on the normalization factor.

Figure 12:
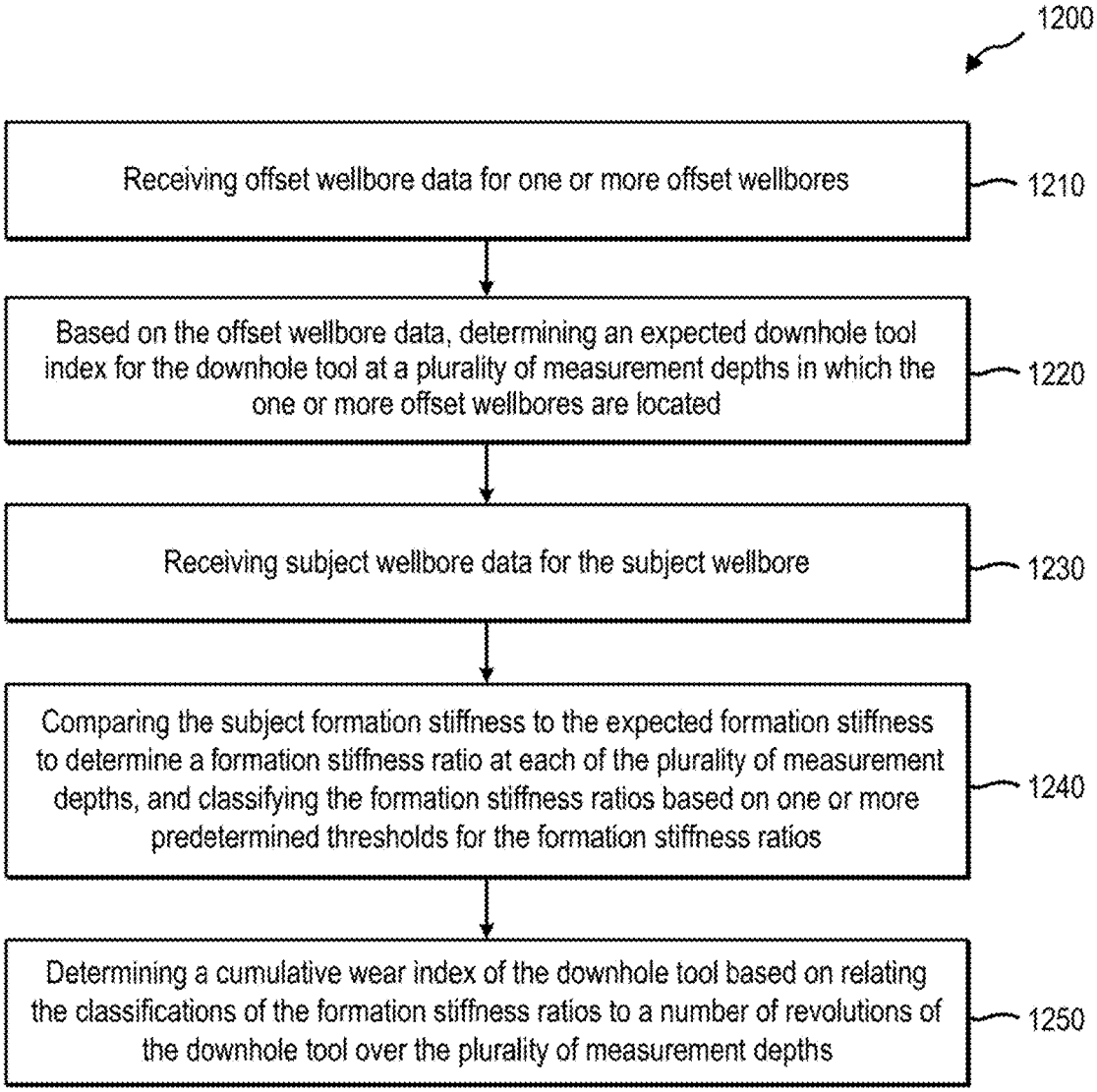
FIG. 12 illustrates a method or a series of acts for determining wear of a downhole tool implemented in a subject wellbore as described herein, according to at least one embodiment of the present disclosure.

FIG. 12 illustrates a flow chart for a method 1200 or a series of acts for detecting wear of a downhole tool implemented in a subject wellbore as described herein, according to at least one embodiment of the present disclosure. While FIG. 12 illustrates acts according to one embodiment, alternative embodiments may add to, omit, reorder, or modify any of the acts of FIG. 12.

In some embodiments, the method 1200 includes an act 1210 of receiving offset wellbore data for one or more offset wellbores.

In some embodiments, the method 1200 includes an act 1220 of, based on the offset wellbore data, determining an expected downhole tool index for the downhole tool at each of a plurality of measurement depths in which the one or more offset wellbores are located.

In some embodiments, the method 1200 includes an act 1230 of receiving subject wellbore data for the subject wellbore.

In some embodiments, the method 1200 includes an act 1240 of, based on the subject wellbore data, determining a subject formation stiffness for the downhole tool at each of the plurality of measurement depths.

In some embodiments, the method 1200 includes an act 1240 of comparing the subject formation stiffness to the expected formation stiffness to determine a formation stiffness ratio at each of the plurality of measurement depths, and classifying the formation stiffness ratios based on one or more predetermined thresholds for the formation stiffness ratios.

In some embodiments, the method 1200 includes an act 1250 of determining a cumulative wear index of the downhole tool based on associating the classifications of the formation stiffness ratios to a number of revolutions of the downhole tool over the plurality of measurement depths. In some embodiments, the method 1200 includes, based on the offset wellbore data, determining a normalization factor for a formation stiffness of the formation. The cumulative wear index may be determined based on normalizing the expected formation stiffness based on the normalization factor. In some embodiments, the method 1200 includes adjusting one or more drilling parameters based on the determined cumulative wear index.

Figure 13:
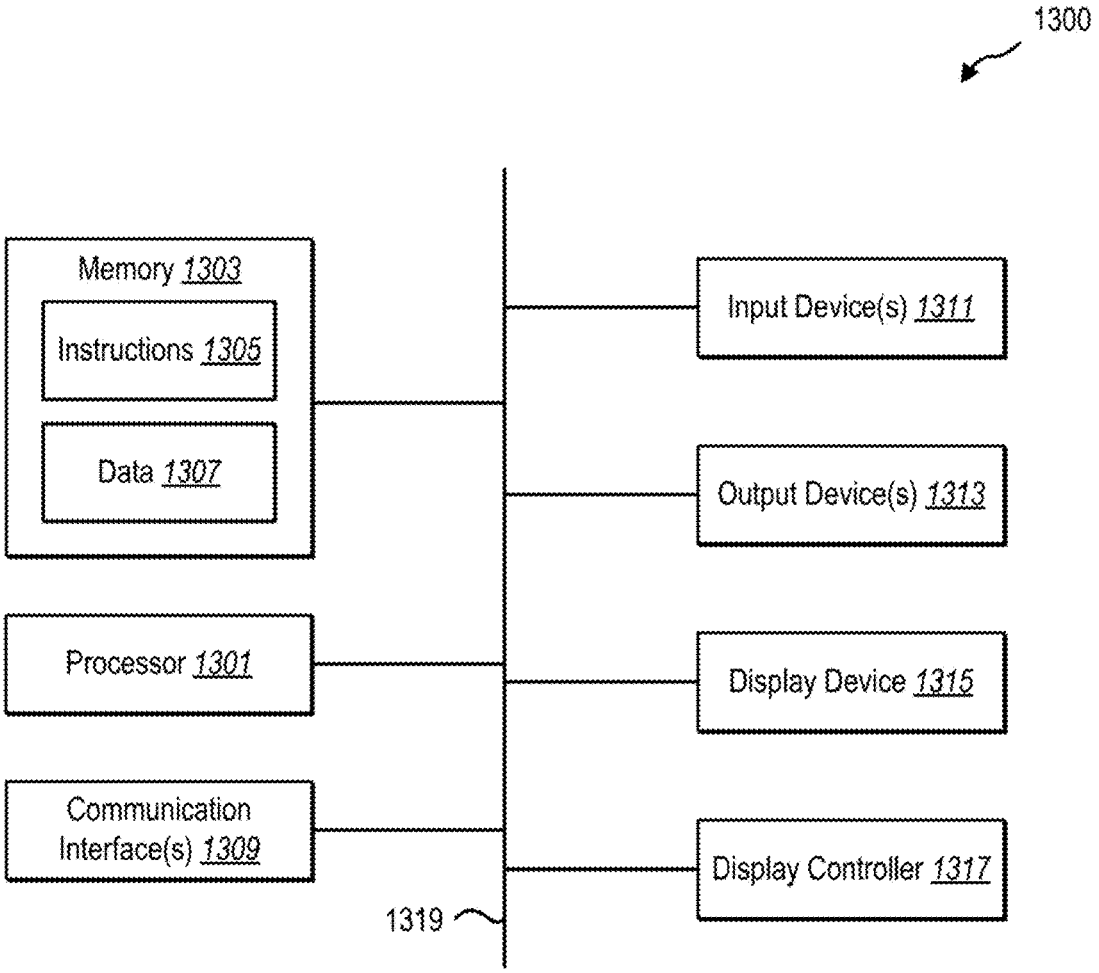
FIG. 13 illustrates certain components that may be included within a computer system.

Turning now to FIG. 13, this figure illustrates certain components that may be included within a computer system 1300. One or more computer systems 1300 may be used to implement the various devices, components, and systems described herein.

The computer system 1300 includes a processor 1301. The processor 1301 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 1301 may be referred to as a central processing unit (CPU). Although just a single processor 1301 is shown in the computer system 1300 of FIG. 13, in an alternative configuration, a combination of processors (e.g., an ARM and DSP) could be used.

The computer system 1300 also includes memory 1303 in electronic communication with the processor 1301. The memory 1303 may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions 1305 and data 1307 may be stored in the memory 1303. The instructions 1305 may be executable by the processor 1301 to implement some or all of the functionality disclosed herein. Executing the instructions 1305 may involve the use of the data 1307 that is stored in the memory 1303. Any of the various examples of modules and components described herein may be implemented, partially or wholly, as instructions 1305 stored in memory 1303 and executed by the processor 1301. Any of the various examples of data described herein may be among the data 1307 that is stored in memory 1303 and used during execution of the instructions 1305 by the processor 1301.

A computer system 1300 may also include one or more communication interfaces 1309 for communicating with other electronic devices. The communication interface(s) 1309 may be based on wired communication technology, wireless communication technology, or both. Some examples of communication interfaces 1309 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 1309 may connect the computer system 1300 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instruction or data structures and which may be accessed by a general purpose or special purpose computer.

A computer system 1300 may also include one or more input devices 1311 and one or more output devices 1313. Some examples of input devices 1311 include a keyboard, mouse, microphone, remote control device, button, joystick, trackball, touchpad, and lightpen. Some examples of output devices 1313 include a speaker and a printer. One specific type of output device that is typically included in a computer system 1300 is a display device 1315. Display devices 1315 used with embodiments disclosed herein may utilize any suitable image projection technology, such as liquid crystal display (LCD), light-emitting diode (LED), gas plasma, electroluminescence, or the like. A display controller 1317 may also be provided, for converting data 1307 stored in the memory 1303 into one or more of text, graphics, or moving images (as appropriate) shown on the display device 1315.

The various components of the computer system 1300 may be coupled together by one or more buses, which may include one or more of a power bus, a control signal bus, a status signal bus, a data bus, other similar components, or combinations thereof. For the sake of clarity, the various buses are illustrated in FIG. 13 as a bus system 1319.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media may be included in computer system components that also (or even primarily) utilize transmission media.

INDUSTRIAL APPLICABILITY

In some embodiments, a downhole system is disclosed for drilling an earth formation to form a wellbore. The downhole system includes a drill rig used to turn a drilling tool assembly which extends downward into the wellbore. The drilling tool assembly may include a drill string, a bottom-hole assembly ("BHA"), and a bit, attached to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. An example BHA may include additional or other downhole drilling tools or components (e.g., coupled between to the drill string and the bit). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system may include other downhole drilling tools, components, and accessories such as special valves (e.g., kelly cocks, blowout preventers, and safety valves). Additional components included in the downhole system may be considered a part of the drilling tool assembly, the drill string, or a part of the BHA, depending on their locations in the downhole system.

The bit in the BHA may be any type of bit suitable for degrading downhole materials. For instance, the bit may be a drill bit suitable for drilling the earth formation. Example types of drill bits used for drilling earth formations are fixed-cutter or drag bits. In other embodiments, the bit may be a mill used for removing metal, composite, elastomer, other materials downhole, or combinations thereof. For instance, the bit may be used with a whipstock to mill into casing lining the wellbore. The bit may also be a junk mill used to mill away tools, plugs, cement, other materials within the wellbore, or combinations thereof. Swarf or other cuttings formed by use of a mill may be lifted to the surface or may be allowed to fall downhole. The bit may include one or more cutting elements for degrading the earth formation.

The BHA may further include a rotary steerable system (RSS). The RSS may include directional drilling tools that change a direction of the bit, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit, change the course of the bit, and direct the directional drilling tools on a projected trajectory. The RSS may steer the bit in accordance with or based on a trajectory for the bit. For example, a trajectory may be determined for directing the bit toward one or more subterranean targets such as an oil or gas reservoir.

The downhole system may include or may be associated with one or more client devices with a wear detection system implemented thereon (e.g., implemented on one, several, or across multiple client devices). The wear detection system may facilitate determining a wear of one or more downhole tools, such as wear of the bit.

In some embodiments, a wear detection system is implemented in an example environment in accordance with one or more embodiments describe herein. The environment includes one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms and/or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via well-site information transfer standard markup language (WITSML) or similar protocol, or any other protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, or function of the downhole system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server device(s) may similarly refer to various types of computing devices. Each of the devices of the environment may include features and/or functionalities described herein.

In some embodiments, the environment includes a wear detection system implemented on one or more computing devices. The wear detection system may be implemented on one or more client device, server devices, and combinations thereof. Additionally, or alternatively, the wear detection system may be implemented across the client devices and/or the server devices such that different portions or components of the wear detection system are implemented on different computing devices in the environment. In this way, the environment may be a cloud computing environment, and the wear detection system may be implemented across one or more devices of the cloud computing environment in order to leverage the processing capabilities, memory capabilities, connectivity, speed, etc., that such cloud computing environments offer in order to facilitate the features and functionalities described herein.

In some embodiments, the wear detection system includes a data manager, a tool index manager, and a report engine. The wear detection system may also include a data storage having subject wellbore data, offset wellbore data, tool index data, and report data stored thereon. While one or more embodiments described herein describe features and functionalities performed by specific components of the wear detection system, it will be appreciated that specific features described in connection with one component of the wear detection system may, in some examples, be performed by one or more of the other components of the wear detection system.

By way of example, one or more of the data receiving, gathering, or storing features of the data manager may be delegated to other components of the wear detection system. As another example, while data may be selected, aligned, filtered, and/or modified by a data manager, in some instances, some or all of these features may be performed by the tool index manager (or other component of the wear detection system). Indeed, it will be appreciated that some or all of the specific components may be combined into other components and specific functions may be performed by one or across multiple components of the wear detection system.

Additionally, while the wear detection system has been described as being implemented on a client device of the downhole system, it should be understood that some or all of the features and functionalities of the wear detection system may be implemented on or across multiple client devices and/or server devices. For example, data may be input and/or received by the data manager on a (e.g., local) client device, and one or more tool indices may be determined by the tool index manager on one or more of a remote, server, or cloud device. Indeed, it will be appreciated that some or all of the specific components may be implemented on or across multiple client devices and/or server devices, including individual functions of a specific component being performed across multiple devices.

As mentioned above, the wear detection system includes a data manager. The data manager may receive a variety of types of data associated with the downhole system and may store the data to the data storage. The data manager may receive the data from a variety of sources, such as from sensors, surveying tools, downhole tools, other (e.g., client) devices, user input, etc.

In some embodiments, the data manager receives subject wellbore data for a subject wellbore. The subject wellbore may be a wellbore of the downhole system associated with the wear detection system as described herein. The subject wellbore may be a wellbore in which a (e.g., subject) downhole tool is actively implemented, or a wellbore that is being actively drilled, lengthened, widened, or otherwise formed.

The subject wellbore data may include information associated with the subject wellbore. For example, the subject wellbore data may indicate one or more of a rate of penetration (ROP), weight on bit (WOB), and rotational speed (RPM) of a subject downhole tool implemented in the subject wellbore. For example, the data manager may receive the subject wellbore data from one or more downhole sensors and/or surface sensors. The subject wellbore data may indicate one or more measurement depths with respect to one or more measurements of the subject wellbore. The subject wellbore data may include any other data, such as torque, pump pressure, flow rate, etc., associated with the subject wellbore and/or with the downhole system. The subject wellbore data may include formation evaluation data, directional drilling data, mud and fluid analysis data, pressure and temperature data, or any other type of data. The data manager may store the subject wellbore data to the data storage.

In some embodiments, some or all the subject wellbore data is measured directly. For example, the data manager may receive one or more of a ROP, WOB, and RPM for the subject downhole tool based on real-time downhole data channel(s) that directly measure the associated value. In some embodiments, some or all the subject wellbore data is indirectly measured and/or is calculated or estimated based on indirect (e.g., surface) measurements. For example, an RPM of a subject downhole tool may be estimated based on a motor curve for a top drive of the downhole system from data channels, such as a flow rate in and/or a differential pressure of the top drive measured at the surface. In another example, a downhole WOB may be estimated based on a surface WOB. In this way, the data manager may receive the subject wellbore data in a variety of ways. This may facilitate accommodating downhole systems of varying levels of cost and/or sophistication. For example, low-cost and/or less sophisticated downhole systems may have fewer data channels and/or measurement equipment for taking downhole measurements and may be limited to surface measurements. As another example, higher-cost and/or more sophisticated downhole systems may have more data channels and/or measurement equipment for taking downhole measurements in addition to surface measurements. In this way, the data manager may collect and/or estimate the relevant data in a variety of ways in order to facilitate implementing the wear detection system within any downhole system.

In some embodiments, the data manager receives at least some of the subject wellbore data in real time. For example, the data manager may be in data communication with one or more downhole or surface sensors and may receive the subject wellbore data, such as a ROP, WOB and/or RPM in real time as the subject wellbore is being actively drilled. These real-time measurements may facilitate one or more of the active and/or real time functionalities of the wear detection system as described herein.

In some embodiments, the data manager receives offset wellbore data for one or more offset wellbores. For example, the offset wellbore data may be associated with a global database for data of all known or available offset wellbores. In another example, the offset wellbore data may be associated with a selection of offset wellbores similar or related to the subject wellbore as described herein.

The offset wellbore data may include any of the data described above in relation to the subject wellbore data, but for the offset wellbores. For example, the offset wellbore data may indicate a ROP, WOB, and RPM of an offset downhole tool implemented in an associated offset wellbore. The offset wellbore data may indicate one or more measurement depths of the offset wellbores in relation to any of the data included in the offset wellbore data. The offset wellbore data may include any other data associated with the offset wellbores. The offset wellbore data may be collected, measured, calculated, or otherwise received in any of the manners described above with respect to the subject wellbore data. The data manager may store the offset wellbore data to the data storage.

In some embodiments, the data manager separates some or all of the offset wellbore data 134 into specific runs. For example, in some cases, multiple runs of one or more offset downhole tools may be made at or within a single wellbore or wellsite, such as to drill different parts of a wellbore, to implement different offset downhole tools within a wellbore, to perform different downhole operations within a wellbore, or to create one or more sidetrack wells off of a wellbore. Accordingly, the data manager may separate the offset wellbore data for a specific offset wellbore or wellsite to represent the various runs into the offset wellbore by one or more offset downhole tools.

In some embodiments, the offset wellbore data includes an indication of a type and/or extent of wear of an offset downhole tool (e.g., a bit) implemented in the associated offset wellbore. For example, the offset wellbores may be wellbores that are already drilled (or are already drilled to or past a measurement depth of interest), and the associated offset downhole tool may have been removed or tripped to the surface for inspection. The offset wellbore data may indicate a classification of a drill bit dull grade for the offset downhole tool, such as based on a IADC dull grade standard. For instance, the offset wellbore data may indicate, for an offset downhole tool, one or more of an inner grade, an outer grade, and a dull characteristic such as ring-out or core-out. In this way, the offset wellbore data may indicate a condition or state of wear of an offset downhole tool associated with a corresponding offset wellbore.

In some embodiments, the data manager selects one or more offset wellbores (e.g., from a database or global collection of offset wellbores) in order to receive the offset wellbore data for those selected offset wellbores. For example, the data manager may identify one or more offset wellbores that have one or more similarities to the subject wellbore. For instance, the similar offset wellbores may be wellbores that are within a same basin, oilfield, region, location, or otherwise are geographically near the subject wellbore. The similar offset wellbores may be wellbores that extend a same or similar depth or range of depths, penetrate a same or similar formation, access a same or similar reservoir, follow a same or similar trajectory (or a portion of a trajectory), have one or more of the same or similar bends or doglegs, or otherwise exhibit a same or similar feature or aspect as the subject wellbore, and combinations thereof. The data manager may accordingly receive the offset wellbore data for these selected similar offset wellbores in order that the offset wellbore data may be relevant to the subject wellbore data.

In some embodiments, the data manager filters the offset wellbore data based on one or more offset wellbores. For example, the data manager may separate or exclude some of the offset wellbore data based on a classification of the drill bit dull grade associated with the corresponding offset wellbore. For instance, the data manager may filter out offset wellbore data associated with offset wellbores having an inner grade and/or an outer grade above one or more thresholds. The data manager may filter out offset wellbore data having one or more specific dull characteristics, such as ring-out or core-out.

As an example, in some cases it may be advantageous to utilize offset wellbore data for wellbores that are not associated with offset downhole tools that were severely dull or damaged (e.g., when removed from the offset wellbore and inspected). The data manager may accordingly filter out offset wellbore data for offset wellbores having one or more of an inner grade of 4 or higher (out of 8), an outer grade of 4 or higher (out of 8), a ring-out characteristic, and a core-out characteristic based on an IADC dull grade standard. Filtering out the severe-wear offset wellbore data may be a minimum or worst-case constraint for implementing the wear detection techniques described herein. In some cases, such as where sufficient offset wellbore data is available, the data manager may filter out offset wellbore data in a more restrictive manner, such as filtering out offset wellbore data for wellbores that are associated with offset downhole tools that exhibit anything more than a slight level of wear. For example, the data manager may filter based on wellbores having one or more of an inner grade of 2 or higher, an outer grade of 2 or higher, or any associated wear characteristic (e.g., ring-out or core-out) on an IADC dull grade standard. In this way, the data manager may filter the offset wellbore data with one or more thresholds of a dull grade standard based on an availability of the offset wellbore data. This may facilitate selecting not only a sufficient amount of offset wellbore data in order to implement the techniques described herein, but may also facilitate selecting the best possible data, for example, for the best runs of offset downhole tools that exhibited less wear. This may facilitate determining with a high confidence that the expected tool indices determined by the wear detection system (as described herein) are an accurate representation of the properties that these indices represent, and are not significantly influenced or affected by dull or worn state of the associated offset downhole tools.

In some embodiments, the data manager does not eliminate some of the offset wellbore data based on the dull grade standard, but separates or categorize the offset wellbore data based on the dull grade standard. For example, the data manager may separate the offset wellbore data into a severe-wear group and a not-severe-wear group of the offset wellbore data. In another example the data manager may separate the offset wellbore data into a wear-group and a no/slight-wear group. Classifying the offset wellbore data in this way may facilitate one or more of the features described herein.

In some embodiments, the data manager receives formation data. The formation data may include information associated with a formation in which the subject wellbore and/or the one or more offset wellbores traverse, penetrate, or are otherwise located (e.g., the subject wellbore data and/or the offset wellbore data may include formation data). For example, the formation data may include information about the geological characteristics of the rock encountered during drilling the subject wellbore and/or the offset wellbores. The formation data may include data from gamma ray sensors, resistivity sensors, porosity sensors, density sensors, sonic sensors, calipers, core samples, or any other formation data. The formation data may indicate the boundaries of different underground formations, such as a top, bottom, and/or thickness of one or more formations. The formation data may indicate one or more measurement depths associated with any of the measurements and/or data described above. In this way, the formation data may identify one or more formations of interest, for example, with respect to the subject wellbore data and/or the offset wellbore data.

In some embodiments, the data manager prepares and/or modifies any of the data it receives and/or has access to. For example, in some cases, wellbore data may be measured and/or recorded in a time-domain. The data manager may translate or depth-gate the data into a depth domain. Put another way, the data manager may modify the data to express the data with respect to measurement depth, for example, instead of with respect to time. Translating the data in this way may facilitate conceptualizing the data and/or the tool indices described herein such that the data may be considered with respect to one or more measurement depths or ranges of measurement depths.

In some embodiments, the data manager aligns one or more instances of the subject wellbore data and/or the offset wellbore data. For example, the data manager may align the subject wellbore data and/or some or all of the offset wellbore data based on a measurement depth or a range of measurement depths (e.g., of interest). In another example, the data manager may align the subject wellbore data and/or some or all of the offset wellbore data based on a formation. For instance, based on the subject wellbore and the offset wellbores penetrating or traversing a same formation, the data manager may align or associate the subject wellbore data measured within the formation with some or all of the offset wellbore data also measured within the same formation (of a respective offset wellbore). The data manager may align the data based on a top of the formation. In some embodiments, this results in the measurement depths of the subject wellbore data and/or some or all of the offset wellbore data being misaligned at one or more locations. For example, a formation may exhibit a slope or dip such that two or more wellbores may reach or penetrate the (e.g., top of the) formation at different measurement depths. It may be advantageous as descried herein to relate the wellbore data of the associated wellbores with respect to the (e.g., location within the) formation as opposed to strictly with respect to the measurement depth, and the data manager may accordingly align the data based on the formation. In some situations, a formation may exhibit a different thickness at one or more locations such that two or more wellbores may penetrate or pass through different thicknesses of the formation. In some embodiments, the data manager compresses and/or stretches the subject wellbore data and/or some or all of the offset wellbore data to account for the differences in thickness. This adjustment may be in addition to the data manager aligning (e.g., a depth of) the data based on the formation. In this way, the data manager may modify the subject wellbore data and/or the offset wellbore data in order to facilitate relating data for any wellbores of interest based on a formation in which the wellbores are positioned (e.g., as opposed to depth).

In some embodiments, the data manager receives user input. The data manager may receive the user input, for example, via any of the client devices and/or server devices. Any of the data described herein may be input or augmented via the user input. For example, in some instances, some or all of the offset wellbore data is received by the data manager as user input. The user input may be received in association with one or more functions or features of the wear detection system, such as part of selecting one or more offset wellbores for the offset wellbore data, selecting one or more thresholds for classifying tool indices, or any other feature described herein.

As mentioned above, the wear detection system includes a tool index manager. The tool index manager may determine and monitor one or more downhole tool indices for characterizing and/or quantifying a wear of the subject downhole tool implemented in the subject wellbore. The downhole tool indices may describe or represent one or more properties or characteristics of the formation and/or of a downhole tool used to degrade the formation of an associated wellbore.

In some embodiments, the tool index manager determines one or more expected downhole tool indices (or expected values of a downhole tool index) based on the offset wellbore data. For example, as discussed below, the tool index manager may determine a formation stiffness at one or more (or all) measurement depths for each offset wellbore of the offset wellbore data. The tool index manager may determine an average, median, percentile, or any other statistical calculation of the determined formation stiffnesses of the offset wellbores as the expected formation stiffness for the subject wellbore at the one or more measurement depths (e.g., or formation-aligned measurement depths). In accordance with at least one embodiment of the present disclosure, the tool index manager determines the expected formation stiffness as a median value of the determined formation stiffnesses of the offset wellbores. In some embodiments, the tool index manager determines a threshold range such as maximum and/or minimum formation stiffnesses based on the determined formation stiffnesses of the offset wellbores. For example, the tool index manager may determine a maximum or upper threshold as a $75^{th}$ percentile (P75), a $90^{th}$ percentile (P90) or any other percentile. In another example, the tool index manager may determine a minimum or lower threshold as a $25^{th}$ percentile (P25), a $10^{th}$ percentile (P10), or any other percentile. The tool index manager may determine the threshold(s) based on a geographic location or application. The tool index manager may determine the expected value in this way for any of a variety of downhole tool indices and for any number of downhole tool indices. The tool index manager may store any of this information to the data storage as tool index data.

In some embodiments, the downhole tool indices include a formation stiffness, K. The formation stiffness K may be a measure or estimation for characterizing the mechanical rigidity or stiffness of the formation, or ability of the formation to resist deformation under an applied load. The formation stiffness may be expressed in terms of Young's Modulus or a Bulk Modulus. The formation stiffness K may be a useful metric for understanding the interaction between a downhole tool and the formation, and may facilitate evaluating the wear of a downhole tool as it proceeds through the formation.

The formation stiffness K may be determined by the following formula:

$$K = \frac{WOB}{\left(\frac{ROP}{RPM}\right)}$$

$WOB$ = Weight on Bit $ROP$ = Rate of Penetration $RPM$ = Downhole Tool Rotational Speed or (Rotations per Minute)

The formation stiffness K may be determined in any other way or in accordance with any other formula or principle for characterizing the formation stiffness K. The formation stiffness K may typically be in a range from 0.1-5 Mlbf/in. The tool index manager may determine the formation stiffness K for one or more wellbores and for one or more (or all) measurement depths of interest. The WOB and/or RPM may be measured from downhole sensors, or may be inferred from surface measurements. In some embodiments, priority is given to higher-confidence measurements (e.g., direct or downhole measurements).

In some embodiments, the downhole tool indices include a mechanical specific energy MSE. The MSE may be a measure or estimation of the unit energy needed to degrade, destroy, or otherwise remove a unit of rock of the formation. The MSE may provide insight into the drilling efficiency and energy consumption during drilling operations of a downhole tool.

The MSE may be determined by the following formula:

$$MSE = \frac{WOB}{A_{bit}} + \frac{120 \cdot \pi \cdot RPM \cdot TOR}{ROP \cdot A_{bit}}$$

$WOB$ = Weight on Bit $ROP$ = Rate of Penetration $RPM$ = Downhole Tool Rotational Speed or (Rotations per Minute)

-continued $TOR$ = Torque on Bit $A_{bit}$ = Area of the Bit

The MSE may be determined in any other way or in accordance with any other formula or principle for characterizing the MSE. The tool index manager may determine the MSE for one or more wellbores and for one or more (or all) measurement depths of interest.

In some embodiments, the downhole tool indices include a bit aggressiveness μ. The bit aggressiveness μ may be a measure or estimation of the frictional coefficient between a downhole tool and the formation given the applied weight and torque.

The bit aggressiveness μ may be determined by the following formula:

$$\mu = \frac{36 \cdot TOR}{WOB \cdot D_{bit}}$$

$WOB$ = Weight on Bit $TOR$ = Torque on Bit $D_{bit}$ = Diameter of the Bit

The bit aggressiveness may be determined in any other way or in accordance with any other formula or principle for characterizing the bit aggressiveness μ. The tool index manager may determine the bit aggressiveness μ for one or more wellbores and for one or more (or all) measurement depths of interest.

In some embodiments, the downhole tool indices include a penetration per revolution PPR. The PPR may represent the distance a downhole tool advances through a formation during each revolution of the downhole tool.

The PPR may be determined by the following formula:

$$\frac{ROP}{RPM}$$

$ROP$ = Rate of Penetration $RPM$ = Downhole Tool Rotational Speed or (Rotations per Minute)

The PPR may be determined in any other way or in accordance with any other formula or principle for characterizing the PPR. The tool index manager may determine the PPR for one or more wellbores and for one or more (or all) measurement depths of interest.

In this way, the tool index manager may determine one or more of these downhole tool indices, any other relevant index or metric, for characterizing and/or quantifying the wear of an associated downhole tool.

In some embodiments, the tool index manager determines and monitors one or more of these downhole tool indices for the subject wellbore and/or the subject downhole tool. For example, based on the subject wellbore data, the tool index manager may determine (e.g., actively and/or in real time) a subject downhole tool index for the subject wellbore. For instance, the tool index manager may determine an active, current, or real-time formation stiffness (or other downhole tool index) for the subject wellbore based on the real-time subject wellbore data. The tool index manager may store the subject downhole tool index information to the data storage as tool index data.

As described in further detail below, determining the subject downhole tool index may facilitate evaluating the wear state of the downhole tool. Comparing a subject downhole tool index to an associated expected downhole tool index and/or thresholds of the expected downhole tool index may facilitate conceptualizing the extent or degree of wear of the subject downhole tool based on the characteristic, aspect, or property that the associated downhole tool index represents. For example, an expected formation stiffness $K_{exp}$ may be determined based on various offset wellbores that are similar to the subject wellbore in one or more regards. As discussed above, the offset wellbore data may be filtered to remove offset wellbore data associated with offset downhole tools that exhibited wear to a certain degree. Accordingly, the expected formation stiffness $K_{exp}$ may be determined to a high degree of accuracy, or in other words, with a high degree of confidence that the determined expected formation stiffness $K_{exp}$ accurately represents that the actual stiffness of the formation without being influenced by a dull condition of the offset downhole tools of the underlying data. The tool index manager may determine, in real time, a subject formation stiffness $K_{subj}$ based on the real-time subject wellbore data. The subject wellbore data and the offset wellbore data may be aligned based on the formation such that the expected formation stiffness $K_{exp}$ may represent the actual formation stiffness of the formation at the location within the formation where the subject downhole tool is currently positioned. By comparing the subject formation stiffness $K_{subj}$ to the expected formation stiffness $K_{exp}$ the wear state of the subject downhole tool may be discerned. For example, the subject formation stiffness $K_{subj}$ being observed to increase above what is expected may signal that the subject downhole tool is becoming or has become worn (e.g., as opposed to signaling that the formation stiffness is increasing, which may be known not to be the case based on the high confidence of the expected formation stiffness $K_{exp}$).

A similar methodology may follow with respect to any of the downhole tool indices described herein. For example, a subject mechanical specific energy, $MSE_{subj}$ being observed to increase above an expected mechanical specific energy $MSE_{exp}$ may indicate that more energy is being utilized to remove an equivalent unit of rock of the formation, which may signal that the bit is becoming dull (e.g., as opposed to signaling that the rock is becoming harder). In another example, a subject bit aggressiveness $\mu_{subj}$ being observed to decrease below an expected bit aggressiveness exp may indicate that the friction between the subject downhole tool and the formation has decreased. This may accordingly signal that the subject downhole tool is encountering less frictional resistance from the formation due to a dull bit, as opposed to the formation becoming softer for example. In another example, a subject penetration per revolution $PPR_{subj}$ being observed to decrease below an expected penetration per revolution $PPR_{exp}$ may indicate that the subject downhole tool is progressing through the formation less per each revolution. This may accordingly signal that the subject downhole tool is struggling more to remove material from the formation due to a dull bit, as opposed to the formation becoming harder for example. In this way, the downhole tool indices described herein (or any other index), when comparing a subject index to an expected index, may facilitate characterizing and/or quantifying the state of wear of the subject downhole tool based on the different properties that the respective downhole tool indices represent.

In some embodiments, the tool index manager determines an index ratio (IR) of a subject downhole tool index to a corresponding expected downhole tool index. For example, the tool index manager may determine an IR for the formation stiffness as a ratio of the subject formation stiffness to the corresponding expected formation stiffness (e.g., a formation stiffness ratio FSR as referred to herein). The tool index manager may determine an IR for any of the downhole tool indices described herein. The IR in this way may facilitate comparing the subject downhole tool indices to the corresponding expected downhole tool indices. For example, while it may be useful to view and compare values and/or plotted representations of the subject downhole tool indices and expected downhole tool indices (e.g., side-by-side), the IR may provide a quantified representation of this comparison.

In some embodiments, the tool index manager classifies the IR (and accordingly classifies the wear of the subject downhole tool) based on one or more predetermined thresholds for the IR. Example thresholds may be established and implemented for any IR for any downhole tool index. Potential FSR values may be divided into several categories or classifications. An FSR from 0 to 2 may be a minimum, low, or acceptable classification for the FSR. An FSR over 3.5 may be a maximum, or severe classification for the FSR. There may also be one or more intermediate classifications, such as medium and/or high, for the FSR. The classification for the FSR may be determined based on historical data from (e.g., geographically close) offset wellbores and/or from selected wellbores from a similar application (e.g., if no close offset wellbores are available). The tool index manager may determine and/or classify the FSR for any (or all) measurement depths of the subject wellbore, including an active measurement depth. For example, the tool index manager may determine and update the FSR and associated classification in real time and during drilling to provide an accurate and active representation of the wear state of the subject downhole tool. The FSR in this way may provide a simple and intuitive indication of the level or severity of wear of the subject downhole tool.

In some embodiments, the classifications for the FSR correspond to a rating index or rating system. For example, a first or low classification may correspond to a rating of 0 for the FSR, a next classification may correspond to a rating of 1, and so on. The tool index manager may determine and/or associated the FSR ratings to facilitate one or more functionalities of the wear detection system as described herein. The FSR rating scale and associated classifications may include any other ratings and/or may be formulated in any other way.

The wear detection system has, to this point, been described primarily with respect to one or more downhole tool indices for a subject downhole tool that may be useful for comparing against expected values. For example, the value of a subject downhole tool index may be compared against a corresponding value of an expected downhole tool index at an associated measurement depth and/or moment in time in order to characterize the wear of the subject downhole tool. In this way, the downhole tool indices described above may provide a comparison, for example, at a snapshot in time (e.g., live and/or historical) of the subject wellbore data and the offset wellbore data.

In some embodiments, it may be advantageous to cumulatively conceptualize and/or quantify the wear of a downhole tool with respect to a total wear of a bit over many data points, measurement depths, and/or moments in time. In some embodiments, the tool index manager determines a cumulative wear index (CWI) for the subject downhole tool. The CWI may represent the wear of the subject downhole tool based on associating determined level(s) of wear of the downhole tool (e.g., based on one or more of the downhole tool indices) to a number of revolutions of the downhole tool at the associated level(s) of wear. For example, the CWI may be expressed as equivalent cumulative bit damage revolutions, and may be based on or associated with a determined formation stiffness at one or more (or all) previous measurement depths uphole of an active measurement depth. The CWI may incorporate an RPM and ROP of the subject downhole tool at each measurement depth. The CWI may incorporate an expected formation stiffness at each measurement depth. The expected formation stiffness may be normalized based on a normalization factor. The CWI may incorporate a rating or classification of the FSR, for example, expressed as a value between 0 and 3 (or any other scale). The CWI may be determined by the following formula:

$$CWI = \sum_{i=1}^{n} \frac{\Delta MD_i \cdot RPM_i \cdot 60 \cdot \text{FSR_RI}_i}{ROP_i} \cdot \frac{FS_i}{\text{FS_norm_factor}}$$

$i$ = Summation Index $n$ = Total number of Active Measurement Depths $\Delta MD$ = Change in Measurement Depth from Previous Summation Index $RPM$ = Downhole Tool Rotational Speed or (Rotations per Minute)

FRS_RI = Formation Stiffness Ratio Rating (in the normalized scale)

$FS$ = Expected Formation Stiffness

FS_norm_factor = Normalization Factor to determine the relative level of formation stiffness Additionally, or alternatively, the CWI may be determined by the following formula, with similar parameters definitions as above:

$$CWI = \sum_{i=1}^{n} \frac{\Delta MD_i \cdot RPM_i \cdot 60 \cdot FSR_{RI_i}}{ROP_i} \cdot e^{\frac{FS_i}{FS_norm_factor}}$$

The CWI may be determined in any other way or in accordance with any other formula or principle for characterizing the CWI. For example, while the CWI is described specifically with respect to the formation stiffness and the FSR, in some embodiments, the CWI is determined with respect to one or more other downhole tool indices, for example, in addition to or in place of the formation stiffness. The tool index manager may determine and/or update the CWI in real time and while drilling in order to provide a live indication of the CWI.

The CWI may represent a cumulative or totality of the wear of the subject downhole tool over some or all of the measurement depths of the subject wellbore. For example, the CWI may relate the determined level or classification of wear (e.g., rating of the FSR as described herein) to a number of revolutions that the downhole tool has completed while being observed to have that rating/classification of wear. The CWI may be a summation of a plurality of non-negative values such that the CWI, over time, may only stay constant or increase. This may be consistent with the real-world behavior of the wear of downhole tools, which may, for a time, be constant and relatively low, but over time may wear to a further and further degree. The rating associated with the lowest (e.g., acceptable) FSR classification may be 0, and the CWI (e.g., due to the FSR_RI term) may also be 0 while the subject downhole tool is being observed at or within the lowest wear classification (e.g., a summation of trivial or zero-value terms). As the determined FSR classification/rating becomes non-zero (e.g., medium, high, or severe) based on the underlying subject formation stiffness exceeding the expected formation stiffness, the CWI may account for a number of revolutions in which the downhole tool is observed with this non-zero wear classification. Accordingly, the CWI calculation may include a sum of one or more non-zero iterations representative of these revolutions at non-trivial (e.g., medium, high, or severe) levels of wear. In this way, the CWI may, over time, increase based on instances of an elevated FSR, but the level of increase may be dependent on an associated amount of revolutions of the downhole tool.

In this way, the CWI may provide a more detailed characterization of the wear of the subject downhole tool than, for example, the downhole tool indices discussed above. For example, the IR of the downhole tool indices discussed above may provide a valuable, but simple, comparison of subject (e.g., actual) vs. expected values at a snapshot in time, but the CWI may provide a more detailed characterization by accounting for how long the subject downhole tool interacts with the formation at above-expected index values. In some embodiments, the CWI is more reliable and/or stable by showing wear over time. For example, due to the downhole tool indices being associated with a specific moment in time, data quality issues, depth/formation alignment issues, etc., of the offset wellbore data and/or the subject wellbore data may result in spikes or sudden increases in the IR between actual and expected values (as described below). It may be difficult to discern whether these spikes are due to such data issues or if they are truly indicative of wear of the subject downhole tool. The CWI, however, may not be as susceptible to misalignment or data quality issues, as a sudden spike in the IR, even if large, may only slightly increase the CWI based on an associated number of revolutions being relatively small. Thus, the CWI may more accurately reflect the actual wear of the subject downhole tool due to the time element of the CWI and based on the CWI being cumulative of all identified wear over a (e.g., large) range of operational time of the subject downhole tool.

As mentioned above, the CWI may incorporate a normalization factor for normalizing the expected formation stiffness. The normalization factor may be representative of a typical (e.g., average) formation stiffness observed for relevant or similar wellbores generally, such as at all measurement depths and/or throughout all formations or subterranean layers. For example, the normalization factor may be based on a set of offset wellbores, such as the offset wellbores of offset wellbore data; offset wellbores within a geographical distance from the subject wellbore; offset wellbores in a same oilfield, basin, region, formation, or location as the subject wellbore; offset wellbores within a global database; or any other collection of offset wellbores. The normalization factor may be an average, median, or percentile of all the formation stiffnesses (at all measurement depths) observed throughout the associated relevant offset wellbores. In this way, the normalization factor may be a global statistic representative of a typical formation stiffness for any wellbore generally and at any location and/or measurement depth. The normalization factor may be expressed as a single value, a polynomial, an exponential, or any other suitable expression in order to measure the relative level of the expected formation stiffness as described herein.

The normalization factor may be useful for determining how the expected formation stiffness (e.g., at a specific measurement depth) compares to the typical or average stiffness of the formation or earth generally for the subject wellbore at any measurement depth. For example, the expected formation stiffness at a given measurement depth may be determined to be higher than normal if the expected formation stiffness is greater than the normalization factor. Similarly, the expected formation stiffness at a given measurement depth may be determined to be lower than normal if the expected formation stiffness is less than the normalization factor. This comparison may be implemented for weighting the expected formation stiffness in the calculation of the CWI. For example, as seen in the formula above, the expected formation stiffness may be inversely weighted (e.g., divided) by the normalization factor. This may have the effect of weighting down instances of the expected formation stiffness being lower than normal such that, when summed, these instances increase the cumulative wear to a lesser degree. Similarly, instance of the expected formation stiffness being higher than normal may be weighted up such that, when summed, these instances increase the cumulative wear to a greater degree. The CWI may be determined in this way to reflect the concept that, even given signs of wearing (e.g., elevated FSR) of the downhole tool at a given measurement depth, if the expected formation stiffness is less than normal at that specific measurement depth (e.g., the formation is softer than normal) the subject downhole tool may wear to a lesser degree in the softer-than-normal formation. The CWI may accordingly be determined by weighting such instances lower. Similarly, if the expected formation stiffness is higher than normal at a specific measurement depth (e.g., the formation is harder than normal) the subject downhole tool may wear to a greater degree in the harder-than-normal formation. The CWI may accordingly be determined by weighting such instances higher.

In some embodiments, the tool index manager classifies the CWI based on one or more predetermined thresholds for the CWI. For example, an observed CWI value may be classified into several different categories or classifications. A CWI between 0 and 10,000 revolutions may be a minimum, low, or acceptable classification for the CWI. A CWI over 30,000 revolutions may be a maximum, or severe classification for the CWI. There may also be one or more intermediate classifications, such as medium and/or high, for the CWI. The tool index manager may classify the CWI based on any thresholds or categories consistent with that described herein. The tool index manager may determine and/or classify the CWI for any (or all) measurement depths of the subject wellbore, including an active measurement depth. For example, the tool index manager may determine and update the CWI and associated classification in real time and during drilling to provide an accurate and active representation of the wear state of the subject downhole tool. The CWI in this way may provide a comprehensive and intuitive indication of the level of severity of wear of the subject downhole tool.

In some embodiments, the tool index manager determines one or more summary statistics. The summary statistics may be values, metrics, and/or indications that represent a general property or aspect of the subject wellbore and/or the offset wellbores, for example, at a high level. For example, the summary statistics may include an indication of footage. Based on the offset wellbore data, the tool index manager may determine a footage, or a total drilled distance, associated with a downhole tool of each offset wellbore. The tool index manager may accordingly determine an average, median, or any other statistical calculation, of the footage values for all of the offset wellbores of the offset wellbore data. In this way, the footage summary statistic may give a simple, high-level summary of, for example, what footage the subject downhole tool may be expected to achieve. The tool index manager may determine, in this manner, summary statistics for any other relevant aspect, parameter, or property, such as a rate of penetrations, a CWI, FSR, IR, ROP, etc.

As mentioned above, the wear detection system includes a report engine. The report engine may generate one or more reports. In some embodiments, the report engine displays one or more of the reports via a graphical user interface of a user device.

In some embodiments, the report represents one or more of the downhole tool indices described herein for the offset wellbores and/or the subject wellbore. For example, the report may illustrate the formation stiffnesses determined for several offset wellbores, as well as the subject formation stiffness for a subject wellbore. The report may include one or more other downhole tool indices in addition to or in place of the formation stiffness. The report may indicate the formation stiffnesses for the offset wellbores through a range of measurement depths. The report may indicate the subject formation stiffness for the subject wellbore in real time. For example, the report may indicate an active measurement depth for the subject wellbore, and may indicate the real-time subject formation stiffness at the active measurement depth. The report may indicate the subject formation stiffness at one or more other measurement depths prior to or uphole of the active measurement depth. The report engine may update or regenerate the report continually and/or periodically to represent the active or current value of the subject formation stiffness.

The report may facilitate comparing the values of one or more downhole tool indices of a subject wellbore to those calculated or observed in one or more offset wellbores. This side-by-side comparison may facilitate determining when the subject downhole tool becomes worn. For example, the determined formation stiffnesses of each of the offset wellbores appears consistently between about 1 and 3 Mlbf/in through the range of measurement depths. Additionally, the determined formation stiffness of each of the offset wellbores appears relatively continuous throughout the range of measurement depths. However, the subject formation stiffness of the subject wellbore at a certain point may begin to be elevated above that of the offset wellbores, such as to about 2-8 Mlbf/in. Additionally, the subject formation stiffness is observed to be significantly more disjointed and fragmented than that of the offset wellbores. Accordingly, these data features of the subject formation stiffness of the subject wellbore made evident through comparison with the formation stiffnesses of the offset wellbores may indicate that the subject downhole tool has become worn, damaged, or both. In this way, the report may facilitate identifying a wear state of the subject downhole tool.

The report engine may store the report to the data storage as report data. In some embodiments, the report engine presents the report via a graphical user interface of a user device.

In some embodiments, the report indicates or represents an expected downhole tool index as described herein. For example, the expected downhole tool index may be an expected formation stiffness. The report may indicate or represent a corresponding subject downhole tool index, such as a subject formation stiffness. The report may indicate one or more thresholds or boundaries for the expected downhole tool index. The thresholds may be a maximum and/or minimum, a range of percentiles, standard deviations, or any other threshold or boundary for or based on the expected downhole tool index. The report may illustrate the subject downhole tool index at an active measurement depth. The report engine may update and/or regenerate the report in order to represent the subject downhole tool index in real time and while drilling as the active measurement depth advances down through a formation. The report may include one or more other downhole tool indices and associated thresholds in addition to or in place of the formation stiffness.

In this way, the report may illustrate the subject downhole tool index with respect to the expected downhole tool index and/or the thresholds in order to provide a useful comparison to gauge the observed value of the subject downhole tool index. For example, at a certain measurement depth, the subject downhole tool index may be observed as exceeding both the expected downhole tool index and the threshold one or more times. Additionally, the subject downhole tool index is observed as becoming fragmented and disjointed. In this way, the report may indicate that the subject downhole tool has become dull and/or damaged.

The report engine may store the report to the data storage as report data. In some embodiments, the report engine presents the report via a graphical user interface of a user device.

In some embodiments, the report indicates or represents one or more subject downhole tool indices, expected downhole tool indices and/or thresholds. The report may indicate these metrics for any number of downhole tool indices as discussed herein, such as the formation stiffness, bit aggressiveness, MSE, or PPR, or any other index. The report may indicate one or more measurement depths of the subject wellbore, including at an active measurement depth. In this way, the report may facilitate evaluating one or more of the subject downhole tool indices, for example, against the expected downhole tool indices and/or thresholds.

In some embodiments, the report indicates one or more drilling parameters. For example, the report may indicate, for the range of measurement depths, a ROP, WOB, RPM, torque (TOR), or any other parameters associated with the subject downhole tool and/or the subject wellbore. In some embodiments the report indicates one or more statistical values and/or ranges associated with the drilling parameters. For example, the report may indicate an average, median, etc., for the drilling parameters based on the offset wellbore data. The report may indicate one or more boundaries for the drilling parameters, such as a maximum and/or minimum, quartile range, standard deviation range, a range of percentiles, or any other boundaries. These statistics may be determined by the tool index manager based on the offset wellbore data. In this way, the report may facilitate comparing one or more drilling parameters of the subject wellbore to those implemented by the offset wellbores.

In some embodiments, the report indicates an IR of one or more of the subject downhole tool indices to an associated expected downhole tool index. For example, the report may plot an FSR for the subject wellbore throughout the range of measurement depths. The plot of the FSR may provide a visual representation of both the active (e.g., at the active measurement depth) and historical values of the FSR. In this way, the FSR may be monitored in order to facilitate determining and conceptualizing a level of wear of the subject downhole tool. In some embodiments, the report indicates a classification or rating of the FSR as described herein. For example, a color code or scale (or any other suitable technique) may indicate the classifications of the FSR, such as from low to severe. The FSR may exhibit one or more increases corresponding to deviations of the underlying subject formation stiffness from the expected formation stiffness. The increases may be exhibited as spikes or peaks, or may be smaller or more subtle increases. The report 800 may indicate the increases in the FSR with an associated color (or other indication) of the classification, indicating the extent of the increase. In this way, the report may facilitate identifying instances of the subject formation stiffness (e.g., via the FSR) that may be indicative of wear of the subject downhole tool.

In some embodiments, the report indicates a CWI for the subject downhole tool as described herein. For example, the report may plot the CWI for the subject wellbore throughout the range of measurement depths. The plot of the CWI may provide a visual representation of both the active (e.g., at the active measurement depth) and historical values of the CWI. The report may indicate a classification or rating of the CWI as described herein. For example, a color code or scale (or any other technique) may indicate the classifications of the CWI, such as from low to severe. The classification of wear levels may be determined based on historical data from similar and/or geographically close offset wellbores. For example, the CWI may be calculated for related offset wellbores both with and without sever wear levels in order to determine reference levels for the classification. The CWI may grow or increase over time, consistent with the increase of wear of the subject downhole tool over time. The report may indicate the classification of the CWI by incorporating the associated color (or other indication) of the classification into the plot of the CWI as the CWI advances to increasing wear levels of the classification.

As mentioned above, the CWI may not be as susceptible to misalignment or data quality issues as, for example, the FSR. For example, at one or more measurement depths, the FSR may exhibit a significant spike. The report may indicate the spike is classified as severe. Based on the FSR alone, this spike may indicate that the subject downhole tool is damaged or worn and may need to be removed from the subject wellbore. The corresponding CWI value, however, may indicate that the cumulative wear of the subject downhole tool is still relatively low, and classified as a low level. As mentioned above, the spike and/or high levels of the FSR may factor into the computation of the CWI, but the relatively short span of the spike and accordingly the relatively low number of revolutions of the downhole tool results in only a small increase in the CWI. Additionally, the expected formation stiffness may be observed to be relatively low, which may further reduce the effect of the spike on the CWI, as discussed above. Thus, the CWI may be a more accurate measure of the wear of the subject downhole tool, as based on the FSR alone, it may appear that the subject downhole tool was worn to a severe degree, when in fact the subject downhole tool may not have reached such a severe wear state until a later measurement depth, as may be indicated by the CWI. The spike may accordingly indicate a data alignment issue of the subject wellbore data and the offset wellbore data, for example, rather than the subject downhole tool becoming worn.

In some embodiments, the report indicates one or more summary statistics for the subject downhole tool as described herein. The summary statistics may indicate one or more top-level or high-level properties or values for comparing the performance of the subject downhole tool to the offset downhole tools of the offset wellbores. The summary statistics in this way may provide a simple and accessible evaluation of one or more aspects of the subject wellbore, for example, in contrast to the more detailed information included in other parts of the report.

The report engine may store the report to the data storage as report data. In some embodiments, the report engine presents the report via a graphical user interface of a user device.

In some embodiments, the report engine facilitates identifying that the subject downhole tool has become worn or damaged. For example, based on, or in connection with, any of the reports discussed herein, the report engine may monitor one or more values, metrics, indices, etc., and may generate a flag or alert. For example, the report engine may monitor a subject downhole tool index against an associated expected downhole tool index and/or one or more associated thresholds in order to identify that the subject downhole tool index has surpassed or exceeded one or more of these values. In another example, the report engine may monitor an IR (such as the FSR) to identify when it surpasses a certain value. In another example, the report engine may monitor a CWI against one or more predetermined categories or classifications in order to identify that the CWI changes classifications or reaches a certain classification. The report engine may monitor any value, metric, or index in order to make any relevant determination consistent with that described herein. The report engine may monitor one or more metrics in this way and may generate an alert based on one or more criteria. For example, the alert may be based on a metric surpassing a (e.g., expected) value or threshold (or both). In another example, the alert may be based on a metric surpassing a value to a certain degree, or for a certain amount of time (or distance), or a combination of both. In another example, the alert may be based on a metric being classified as a given category or classification, or based on a metric changing classifications. In another example, the report engine may generate the alert based on a consideration of how much of the subject wellbore is left to drill, or how far from a target the subject wellbore is. For example, the alert may signal to an operator of the downhole system that the subject downhole tool is worn and should be removed and/or replaced. However, in some situations, if the subject wellbore is near completion it may be advantageous to complete drilling of the wellbore with the subject downhole tool despite the wear condition and despite the potential damage to the subject downhole tool. Accordingly, the report engine may incorporate a consideration of remaining drilling distance into the determination to generate an alert.

The report engine may alert a user of the wear detection system. For example, the report engine may present an alert or flag to a user via a graphical user interface of a user device, or may otherwise alert the user. In some embodiments, the report engine facilitates implementing a change to the operation of the downhole system. For example, the report engine may alert a user of the wear state of the subject downhole tool in order that one or more drilling parameters may be adjusted. In some embodiments, the report engine facilitates adjusting one or more drilling parameters based on an identified flag or alert. For example, the report engine may suggest an adjustment to a user, provide information to one or more additional systems regarding the wear state of the subject downhole tool, automatically adjust one or more drilling parameters, stop an operation of the downhole system, or any other action for adjusting the drilling parameters and combinations thereof.

In some embodiments, a method or a series of acts for detecting wear of a downhole tool implemented in a subject wellbore is described herein, according to at least one embodiment of the present disclosure. The method may include the acts described below, and alternative embodiments may add to, omit, reorder, or modify any of the acts.

In some embodiments, the method includes an act of receiving offset wellbore data for one or more offset wellbores. For example, the offset wellbore data may include a rate of penetration, weight on bit, and rotational speed associated with each offset wellbore. In some embodiments, the wear detection system filters out one or more offset wellbores based on a wear condition of a downhole tool of the associated offset wellbores. In some embodiments, the offset wellbore data is based on associated offset wellbores that are in a same formation and/or are at a same depth as the subject wellbore.

In some embodiments, the method includes an act of, based on the offset wellbore data, determining an expected downhole tool index for the downhole tool at one or more measurement depths including an active measurement depth of the subject wellbore. For example, the expected downhole tool index may be an expected formation stiffness of the subject wellbore at one or more measurement depths based on the offset wellbore data. The expected downhole tool index may be a median downhole tool index based on the offset wellbore data. In another example, the expected downhole tool index may be an expected mechanical specific energy of a formation, an expected bit aggressiveness of the downhole tool, or an expected penetration per revolution of the downhole tool, based on the offset wellbore data.

In some embodiments, the method includes an act of receiving subject wellbore data.

In some embodiments, the method includes an act of, based on the subject wellbore data, determining a subject downhole tool index in real time for the downhole tool at the active measurement depth.

In some embodiments, the method includes an act of determining the wear of the downhole tool based on comparing the subject downhole tool index to the expected downhole tool index at the active measurement depth. In some embodiments, the wear detection system aligns the subject wellbore data with the offset wellbore data based on a depth of the formation. In some embodiments, the wear detection system classifies the determined wear of the downhole tool based on one or more predetermined thresholds for the subject downhole tool index. In some embodiments, the wear detection system determines a downhole tool index ratio of the subject downhole tool index to the expected downhole tool index.

In some embodiments, the method includes generating a plot representing the expected downhole tool index and the subject downhole tool index. In some embodiments, the plot represents the downhole tool index ratio. In some embodiments, the method includes adjusting one or more drilling parameters based on the determined wear of the downhole tool.

In some embodiments, a method or a series of acts for detecting wear of a downhole tool implemented in a subject wellbore is described herein, according to at least one embodiment of the present disclosure. The method may include the acts described below, and alternative embodiments may add to, omit, reorder, or modify any of the acts.

In some embodiments, the method includes an act of receiving offset wellbore data for one or more offset wellbores.

In some embodiments, the method includes an act of, based on the offset wellbore data, determining an expected downhole tool index for the downhole tool at each of a plurality of measurement depths including an active measurement depth of the downhole tool.

In some embodiments, the method includes an act of receiving subject wellbore data for the subject wellbore. For example, the subject wellbore data may include rotation data for the downhole tool.

In some embodiments, the method includes an act of, based on the subject wellbore data, determining a subject downhole tool index for the downhole tool at each of the plurality of measurement depths.

In some embodiments, the method includes an act of, based on comparing the subject downhole tool indices to the expected downhole tool indices, determining a cumulative wear index for the downhole tool over the plurality of measurement depths. For example, the cumulative wear index may associate the comparison of the subject downhole tool indices and the expected downhole tool indices to a rotation of the downhole tool based on the measurement data. For instance, the cumulative wear index may identify a number of revolutions of the downhole tool with respect to the subject downhole tool indices as compared to one or more threshold ranges of the expected downhole tool indices. In some embodiments, the wear detection system classifies the determined cumulative wear index based on one or more predetermined thresholds. In some embodiments, the wear detection system determines a normalization factor for a formation of the one or more offset wellbores and of the subject wellbore. The cumulative wear index may be determined based on normalizing the expected downhole tool index based on the normalization factor.

In some embodiments, a method or a series of acts for detecting wear of a downhole tool implemented in a subject wellbore is described herein, according to at least one embodiment of the present disclosure. The method may include the acts described below, and alternative embodiments may add to, omit, reorder, or modify any of the acts.

In some embodiments, the method includes an act of receiving offset wellbore data for one or more offset wellbores.

In some embodiments, the method includes an act of, based on the offset wellbore data, determining an expected downhole tool index for the downhole tool at each of a plurality of measurement depths in which the one or more offset wellbores are located.

In some embodiments, the method includes an act of receiving subject wellbore data for the subject wellbore.

In some embodiments, the method includes an act of, based on the subject wellbore data, determining a subject formation stiffness for the downhole tool at each of the plurality of measurement depths.

In some embodiments, the method includes an act of comparing the subject formation stiffness to the expected formation stiffness to determine a formation stiffness ratio at each of the plurality of measurement depths, and classifying the formation stiffness ratios based on one or more predetermined thresholds for the formation stiffness ratios.

In some embodiments, the method includes an act of determining a cumulative wear index of the downhole tool based on associating the classifications of the formation stiffness ratios to a number of revolutions of the downhole tool over the plurality of measurement depths. In some embodiments, the method includes, based on the offset wellbore data, determining a normalization factor for a formation stiffness of the formation. The cumulative wear index may be determined based on normalizing the expected formation stiffness based on the normalization factor. In some embodiments, the method includes adjusting one or more drilling parameters based on the determined cumulative wear index.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is shown in the computer system, in an alternative configuration, a combination of processors (e.g., an ARM and DSP) could be used.

The computer system also includes memory in electronic communication with the processor. The memory may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instruction or data structures and which may be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into one or more of text, graphics, or moving images (as appropriate) shown on the display device.

The various components of the computer system may be coupled together by one or more buses, which may include one or more of a power bus, a control signal bus, a status signal bus, a data bus, other similar components, or combinations thereof. For the sake of clarity, the various buses are described as a bus system.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media maybe included in computer system components that also (or even primarily) utilize transmission media.

The embodiments of the wear detection system have been primarily described with reference to wellbore drilling operations; the wear detection system described herein may be used in applications other than the drilling of a wellbore. In other embodiments, the wear detection system according to the present disclosure may be used outside a wellbore or other downhole environment used for the exploration or production of natural resources. For instance, the wear detection system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of detecting wear of a downhole tool implemented in a subject wellbore, comprising: receiving offset wellbore data for one or more offset wellbores;

based on the offset wellbore data, determining an expected formation stiffness at each of a plurality of measurement depths of a formation in which the one or more offset wellbores and the subject wellbore are located;

receiving subject wellbore data for the subject wellbore; based on the subject wellbore data, determining a subject formation stiffness for the downhole tool at each of the plurality of measurement depths;

comparing the subject formation stiffnesses to the expected formation stiffnesses to determine a formation stiffness ratio at each of the plurality of measurement depths, and classifying the formation stiffness ratios based on one or more predetermined thresholds for the formation stiffness ratios;

determining a cumulative wear index of the downhole tool based on associating the classifications of the formation stiffness ratios to a number of revolutions of the downhole tool over the plurality of measurement depths; and determining that the cumulative wear index exceeds a threshold and in response completing at least one of: removing the downhole tool and replacing the downhole tool.

2. The method of claim 1, further comprising, based on the offset wellbore data, determining a normalization factor for a formation stiffness of the formation, and wherein determining the cumulative wear index includes normalizing the expected formation stiffness based on the normalization factor.

3. The method of claim 1, further comprising adjusting one or more drilling parameters based on the determined cumulative wear index.

4. The method of claim 1, wherein the offset wellbore data includes a rate of penetration, weight on bit, and rotational speed associated with each offset wellbore.

5. The method of claim 1, wherein receiving the offset wellbore data includes selecting a set of offset wellbores that are one or more of: in a same formation as the subject wellbore, at a same depth of the subject wellbore, and implement a similar operation as the subject wellbore.

6. The method of claim 1, further comprising adjusting one or more drilling parameters based on the subject formation stiffness for the downhole tool.

7. The method of claim 1, further comprising classifying the determined cumulative wear index based on the one or more predetermined thresholds.

8. A system, comprising:

one or more processors:

a memory in electronic communication with the one or more processors; and instructions stored in the memory, the instructions being executable by the one or more processors to;

receive offset wellbore data for one or more offset wellbores;

based on the offset wellbore data, determine an expected formation stiffness at each of a plurality of measurement depths of a formation in which the one or more offset wellbores and a subject wellbore are located;

receive subject wellbore data for the subject wellbore;

based on the subject wellbore data, determine a subject formation stiffness for a downhole tool at each of the plurality of measurement depths;

compare the subject formation stiffnesses to the expected formation stiffnesses to determine a formation stiffness ratio at each of the plurality of measurement depths, and classify the formation stiffness ratios based on one or more predetermined thresholds for the formation stiffness ratios;

determine a cumulative wear index of the downhole tool based on associating the classifications of the formation stiffness ratios to a number of revolutions of the downhole tool over the plurality of measurement depths; and determine that the cumulative wear index exceeds a threshold and in response completing at least one of: remove the downhole tool and replace the downhole tool.

9. The system of claim 8, further comprising instructions executable by the processor to, based on the offset wellbore data, determine a normalization factor for a formation stiffness of the formation, and wherein determining the cumulative wear index includes normalizing the expected formation stiffness based on the normalization factor.

10. The system of claim 8, further comprising instructions executable by the processor to adjust one or more drilling parameters based on the determined cumulative wear index.

11. The system of claim 8, wherein the offset wellbore data includes a rate of penetration, weight on bit, and rotational speed associated with each offset wellbore.

12. The system of claim 8, further comprising instructions executable by the processor to select a set of offset wellbores that are one or more of: in a same formation as the subject wellbore, at a same depth of the subject wellbore, and implement a similar operation as the subject wellbore.

13. The system of claim 8, further comprising instructions executable by the processor to adjust one or more drilling parameters based on the subject formation stiffness for the downhole tool.

14. The system of claim 8, further comprising instructions executable by the processor to classify the determined cumulative wear index based on the one or more predetermined thresholds.

15. A non-transitory computer-readable storage medium including instructions that, when executed by at least one processor, cause the processor to:

receive offset wellbore data for one or more offset wellbores;

based on the offset wellbore data, determine an expected formation stiffness at each of a plurality of measurement depths of a formation in which the one or more offset wellbores and a subject wellbore are located;

receive subject wellbore data for the subject wellbore;

based on the subject wellbore data, determine a subject formation stiffness for the downhole tool at each of the plurality of measurement depths;

compare the subject formation stiffnesses to the expected formation stiffnesses to determine a formation stiffness ratio at each of the plurality of measurement depths, and classify the formation stiffness ratios based on one or more predetermined thresholds for the formation stiffness ratios;

determine a cumulative wear index of the downhole tool based on associating the classifications of the formation stiffness ratios to a number of revolutions of the downhole tool over the plurality of measurement depths; and determine that the cumulative wear index exceeds a threshold and in response completing at least one of: remove the downhole tool and replace the downhole tool.

16. The non-transitory computer-readable storage medium of claim 15, further comprising instructions to, based on the offset wellbore data, determine a normalization factor for a formation stiffness of the formation, and wherein the instructions to determine the cumulative wear index includes instructions to normalize the expected formation stiffness based on the normalization factor.

17. The non-transitory computer-readable storage medium of claim 15, further comprising instructions to adjust one or more drilling parameters based on the determined cumulative wear index.

18. The non-transitory computer-readable storage medium of claim 15, wherein the offset wellbore data includes a rate of penetration, weight on bit, and rotational speed associated with each offset wellbore.

19. The non-transitory computer-readable storage medium of claim 15, wherein the instructions to receive the offset wellbore data includes instructions to select a set of offset wellbores that are one or more of: in a same formation as the subject wellbore, at a same depth of the subject wellbore, and implement a similar operation as the subject wellbore.

20. The non-transitory computer-readable storage medium of claim 15, further comprise instructions to adjust one or more drilling parameters based on the subject formation stiffness for the downhole tool.

21. The non-transitory computer-readable storage medium of claim 15, further comprise instructions to classify the determined cumulative wear index based on the one or more predetermined thresholds.

* * * * *